US009685694B2

(12) United States Patent
Choi et al.

(10) Patent No.: US 9,685,694 B2
(45) Date of Patent: Jun. 20, 2017

(54) ANTENNA MODULE AND MOBILE TERMINAL USING THE SAME

(71) Applicant: LG ELECTRONICS INC., Seoul (KR)

(72) Inventors: Jaehyun Choi, Seoul (KR); Hyengcheul Choi, Seoul (KR); Chisang You, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 103 days.

(21) Appl. No.: 14/702,524

(22) Filed: May 1, 2015

(65) Prior Publication Data

US 2016/0164168 A1 Jun. 9, 2016

(30) Foreign Application Priority Data

Dec. 4, 2014 (KR) ..... 10-2014-0173074

(51) Int. Cl.
*H01Q 1/24* (2006.01)
*H01Q 7/00* (2006.01)
(Continued)

(52) U.S. Cl.
CPC ..... *H01Q 1/243* (2013.01); *H01Q 1/48* (2013.01); *H01Q 1/50* (2013.01); *H01Q 1/52* (2013.01);
(Continued)

(58) Field of Classification Search
USPC ..... 343/702, 700 MS, 748, 846, 848
See application file for complete search history.

(56) References Cited

U.S. PATENT DOCUMENTS 9,178,280 B2 * 11/2015 Liu ..... H01Q 7/005
2011/0001673 A1 * 1/2011 You ..... H01Q 1/243 343/702
(Continued)

FOREIGN PATENT DOCUMENTS

CN 103117452 5/2013
CN 203503779 3/2014
(Continued)

OTHER PUBLICATIONS

European Patent Office Application Serial No. 15001330.8, Search Report dated Mar. 8, 2016, 8 pages.
(Continued)

*Primary Examiner* — Khai M Nguyen
(74) *Attorney, Agent, or Firm* — Lee Hong Degerman Kang & Waimey

(57) ABSTRACT

The present disclosure relates to an antenna module and a mobile terminal having the same, and the antenna module may include a first conductive member connected to a feeding portion and a grounding portion, a second conductive member disposed to be separated from the first conductive member, a first connecting member configured to connect the first conductive member to the second conductive member at a position adjacent to the feeding portion, and a second connecting member configured to connect the first conductive member to the second conductive member at a position adjacent to the grounding portion, wherein a slit is formed on the first conductive member, and the slit is formed between the feeding portion and the grounding portion.

29 Claims, 19 Drawing Sheets

(51) Int. Cl.

| | |
|---|---|
| ***H01Q 9/26*** | (2006.01) |
| ***H01Q 5/30*** | (2015.01) |
| ***H01Q 1/48*** | (2006.01) |
| ***H01Q 1/50*** | (2006.01) |
| ***H01Q 1/52*** | (2006.01) |

(52) U.S. Cl.
CPC ..... *H01Q 5/30* (2015.01); *H01Q 7/00* (2013.01); *H01Q 9/26* (2013.01)

(56) References Cited

U.S. PATENT DOCUMENTS

| | | | | |
|---|---|---|---|---|
| 2012/0218723 | A1* | 8/2012 | Kwak ..... | H01Q 1/243<br>361/748 |
| 2013/0069842 | A1 | 3/2013 | Lee et al. | |
| 2014/0333495 | A1 | 11/2014 | Vazquez et al. | |

FOREIGN PATENT DOCUMENTS

| | | |
|---|---|---|
| EP | 2405534 | 1/2012 |
| GB | 2484540 | 4/2012 |

OTHER PUBLICATIONS

European Patent Office Application Serial No. 15001330.8, Search Report dated Jul. 11, 2016, 19 pages.

* cited by examiner

ANTENNA MODULE AND MOBILE TERMINAL USING THE SAME

CROSS-REFERENCE TO RELATED APPLICATIONS

Pursuant to 35 U.S.C. §119(a), this application claims the benefit of earlier filing date and rights of priority to Korean Application 10-2014-0173074, filed on Dec. 4, 2014, the contents of which are incorporated by reference herein in its entirety.

BACKGROUND OF THE INVENTION

1. Field of the Invention

The present disclosure relates to a mobile terminal having an antenna module for transmitting and receiving wireless signals.

2. Description of the Related Art

Terminals may be generally classified into mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

As it becomes multifunctional, a mobile terminal can be allowed to capture still images or moving images, play music or video files, play games, receive broadcast and the like, so as to be implemented as an integrated multimedia player.

Various new attempts have been made in the aspect of hardware or software in order to support and enhance the function of such a mobile terminal.

Antenna as a device formed to transmit and receive wireless electromagnetic waves for wireless communication is a constituent element essentially required for a mobile terminal. A mobile terminal has a tendency to implement various functions such as LTE, DMB, and the like, in addition to voice calls, and therefore, an antenna should implement bandwidths satisfying the functions, and of course should be designed in a small size to be integrated into the mobile terminal.

A planar inverted-F antenna (PIFA), typically used in mobile terminals, has a narrow bandwidth, thus causing difficulties to obtain broadband antenna characteristics. According to the foregoing requirement, structural improvements for implementing a multi-band operation have been carried out.

Furthermore, due to the trend in mobile terminals, the size of a bezel has been gradually reduced, thereby resulting in an insufficient arrangement space of the antenna. In view of the circumstances, in recent years, mobile terminals using a metallic member itself forming an external appearance thereof as an antenna have been released on the market.

SUMMARY OF THE INVENTION

An aspect of the present disclosure is to solve the foregoing problem and other problems. Another aspect of the present disclosure is to propose a mobile terminal having an antenna apparatus capable of obtaining broadband characteristics.

The present disclosure is to propose a mobile terminal having a new structure configured to use a metallic member itself forming an external appearance of the mobile terminal as an antenna.

In order to accomplish the above and other objects, according to an aspect of the present disclosure, there is provided an antenna module, including a first conductive member connected to a feeding portion and a grounding portion, a second conductive member disposed to be separated from the first conductive member, a first connecting member configured to connect the first conductive member to the second conductive member at a position adjacent to the feeding portion, and a second connecting member configured to connect the first conductive member to the second conductive member at a position adjacent to the grounding portion, wherein a slit is formed on the first conductive member, and the slit is formed between the feeding portion and the grounding portion.

A position at which the first connecting member is connected to the first conductive member may vary between a portion connected to the feeding portion and an end of the first conductive member.

According to an aspect of the present invention, a position at which the second connecting member is connected to the first conductive member may vary between a portion connected to the grounding portion and an end of the first conductive member.

According to an aspect of the present invention, the antenna module may further include a third connecting member one end portion of which is connected to the first conductive member, and the other end portion of which is connected to the second conductive member, wherein a position connected to the first conductive member varies between a portion connected to the grounding portion and a portion connected to the second connecting member, and a position connected to the second conductive member varies between a portion connected to the first connecting member and a portion connected to the second connecting member.

According to an aspect of the present invention, the antenna module may further include a sub-arm one end portion of which is connected to the first conductive member or second conductive member or grounded to the ground, and the other end portion of which is open, wherein the one end portion is formed between a portion connected to the grounding portion and a portion connected to the third connecting member when one end portion of the sub-arm is connected to the first conductive member, and the one end portion is formed between a portion connected to the first connecting member and a portion connected to the third connecting member when one end portion of the sub-arm is connected to the second conductive member, and at least part of the other end portion is formed adjacent to the second conductive member to be separated therefrom when one end portion of the sub-arm is connected to the ground.

According to an aspect of the present invention, the first conductive member may include a first portion connected to the grounding portion and a second portion connected to the feeding portion to form the slit separated from the first portion by a predetermined distance.

According to an aspect of the present invention, a first matching module for impedance matching may be disposed on a feeding line connected to the feeding portion to feed the first conductive member.

According to an aspect of the present invention, a first variable switch for controlling a current flowing through the second portion may be connected to the first matching module.

According to an aspect of the present invention, a second matching module for impedance matching may be disposed on a grounding line connected to the grounding portion to ground the first conductive member.

According to an aspect of the present invention, a second variable switch for controlling a current flowing through the first portion may be connected to the second matching module.

According to an aspect of the present invention, a third variable switch for controlling a current flowing through the sub-arm may be formed on the sub-arm.

According to another aspect of the present invention, there is provided an antenna module, including a first conductive member fed by a first feeding portion, a second conductive member disposed to be separated from the first conductive member, and fed by a second feeding portion, a first connecting member connecting the first conductive member to the second conductive member at a position adjacent to the first feeding portion, and a second connecting member one end portion of which is connected to the first conductive member, and the other end portion of which is connected to the second conductive member, wherein a position of the one end portion varies between a portion connected to the first feeding portion and an end of the first conductive member, and a position of the other end portion varies between a portion connected to the second feeding portion and an end of the second conductive member, wherein the first conductive member and second conductive member are open at a position adjacent to the second feeding portion.

According to an aspect of the present invention, the antenna module may further include a sub-arm formed on the second conductive member, one end portion of which is formed between a portion connected to the second feeding portion and an open end of the second conductive member, and the other end portion of which is open.

According to an aspect of the present invention, the antenna module may further include a first block member formed between a portion connected to the second connecting member and a portion connected to the second feeding portion on the second conductive member to block a current generated from the second feeding portion from flowing to a first feeding portion.

According to an aspect of the present invention, the antenna module may further include a second block member formed on a second feeding line connected to the second feeding portion to feed the second conductive member so as to block a current generated from the first feeding portion from flowing to a second feeding portion.

According to an aspect of the present invention, the first conductive member may be grounded to the ground by a grounding line, and a second variable switch may be formed on the grounding line.

According to an aspect of the present invention, a first matching module may be formed on a first feeding line for feeding the first conductive member.

According to an aspect of the present invention, a first variable switch for controlling a current flowing through the first conductive member may be connected to the first matching module.

According to an aspect of the present invention, the first and the second block member may be configured to include a lumped element.

According to an aspect of the present invention, at least part of the sub-arm may be formed adjacent to the first conductive member to be separated therefrom to generate an electric coupling to the first conductive member.

According to still another aspect of the present invention, there is provided a mobile terminal, including a terminal body, and an antenna module formed on the terminal body, wherein the antenna module includes a first and a second conductive member disposed to be separated from each other, a first and a second connecting member configured to connect both ends of the first conductive member and second conductive member to each other, wherein the first conductive member is connected to a feeding portion and a grounding portion, and a slit is formed on the first conductive member or second conductive member, and the slit is formed between the feeding portion and grounding portion, and a third connecting member one end of which is connected to the second conductive member, and the other end of which is connected to the first conductive member, wherein a position connected to the first conductive member varies between a portion connected to the grounding portion and a portion connected to the second connecting member, and a position connected to the second conductive member varies between a portion connected to the first connecting member and a portion connected to the second connecting member.

According to an aspect of the present invention, one of the first conductive member and second conductive member may form part or all of a lateral appearance of the terminal body, and the other one thereof may be formed within the terminal body.

According to an aspect of the present invention, the first conductive member and second conductive member may be formed on planes, and the planes may be formed to be perpendicular to each other.

According to an aspect of the present invention, the second conductive member may be formed in a non-uniform pattern.

According to an aspect of the present invention, a position at which the first connecting member is connected to the first conductive member may vary between a portion connected to the feeding portion and an end of the first conductive member.

According to an aspect of the present invention, a position at which the second connecting member is connected to the first conductive member may vary between a portion connected to the grounding portion and an end of the first conductive member.

According to an aspect of the present invention, the mobile terminal may further include a sub-arm one end portion of which is connected to the first conductive member, and the other end portion of which is open, wherein one end portion of the sub-arm is formed between a portion connected to the grounding portion and a portion connected to the third connecting member.

According to yet still another aspect of the present invention, there is provided a mobile terminal, including a terminal body, and an antenna module formed on the terminal body, wherein the antenna module includes a first and a second conductive member disposed to be separated from each other, and fed by a first and a second feeding portion, respectively, a first connecting member configured to connect the first conductive member to second conductive member at a position adjacent to the first feeding portion, and a second connecting member one end portion of which is connected to the first conductive member, and the other end portion of which is connected to the second conductive member, wherein a position of the one end portion varies between a portion connected to the first feeding portion and an end of the first conductive member, and a position of the other end portion varies between the second feeding portion and an end of the second conductive member, wherein the first conductive member and second conductive member are open at a position adjacent to the second feeding portion.

According to an aspect of the present invention, one of the first conductive member and second conductive member may form part or all of a lateral appearance of the terminal body, and the other one thereof may be disposed within the terminal body.

According to an aspect of the present invention, the mobile terminal may further include a first block member formed between a portion connected to the second connecting member and a portion connected to the second feeding portion on the second conductive member to block a current generated from the second feeding portion from flowing to a first feeding portion.

According to an aspect of the present invention, the mobile terminal may further include a second block member formed on a second feeding line connected to the first feeding portion to feed the second conductive member so as to block a current generated from the first feeding portion from flowing to a second feeding portion.

According to an aspect of the present invention, the mobile terminal may further include a sub-arm formed on the second conductive member, one end portion of which is formed between a portion connected to the second feeding portion and an open end of the second conductive member, and the other end portion of which is open.

The effect of a mobile terminal according to the present disclosure and a control method thereof will be described as follows.

According to at least one of the embodiments of the present disclosure, there is an advantage in which a metal formed on a lateral appearance of the terminal body can be used as an antenna.

Furthermore, according to at least one of the embodiments of the present disclosure, there is an advantage in which a second conductive member is disposed to be separated from a first conductive member, thereby providing an antenna module which is robust to a mobile terminal having a narrow bezel.

In addition, according to at least one of the embodiments of the present disclosure, a sub-arm, a matching module, a variable switch and the like may be used to implement a frequency having a wider bandwidth.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail according to the exemplary embodiments disclosed herein, with reference to the accompanying drawings. For the sake of brief description with reference to the drawings, the same or equivalent components will be provided with the same reference numbers, and description thereof will not be repeated. A suffix "module" and "unit" used for constituent elements disclosed in the following description is merely intended for easy description of the specification, and the suffix itself does not give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that, although the terms first, second, etc. may be used herein to describe various elements, these elements should not be limited by these terms. These terms are only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation as far as it represents a definitely different meaning from the context.

Terms 'include' or 'has' used herein should be understood that they are intended to indicate an existence of several components or several steps, disclosed in the specification, and it may also be understood that part of the components or steps may not be included or additional components or steps may further be included.

Mobile terminals described herein may include cellular phones, smart phones, laptop computers, digital broadcasting terminals, personal digital assistants (PDAs), portable multimedia players (PMPs), navigators, slate PCs, tablet PCs, ultra books, wearable devices (for example, smart watches, smart glasses, head mounted displays (HMDs)), and the like.

However, it may be easily understood by those skilled in the art that the configuration according to the exemplary embodiments of this specification can also be applied to stationary terminals such as digital TV, desktop computers and the like, excluding a case of being applicable only to the mobile terminals.

Figure 1A:
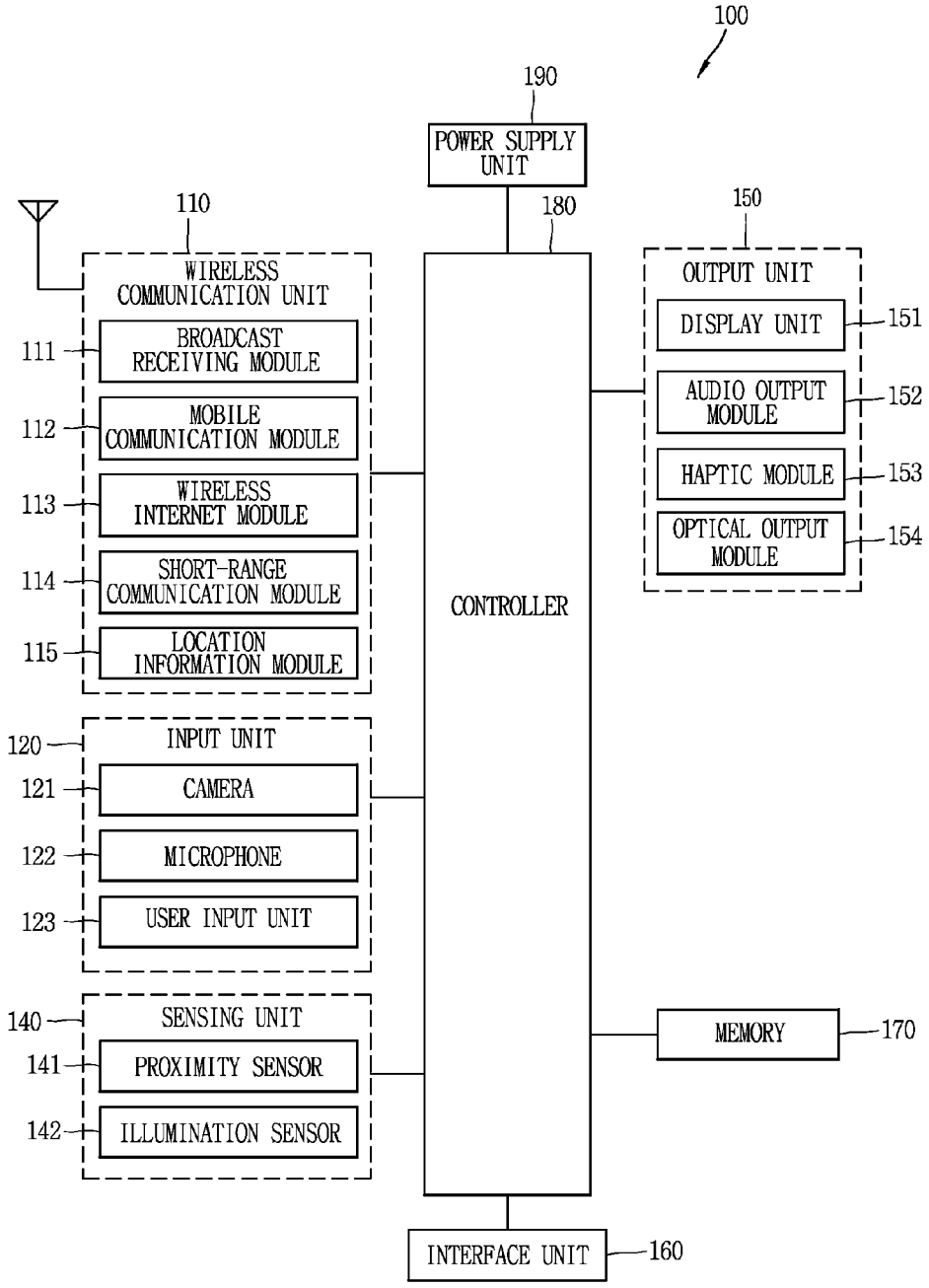
FIG. 1A is a block diagram for explaining a mobile terminal associated with the present disclosure.
Figure 1B:
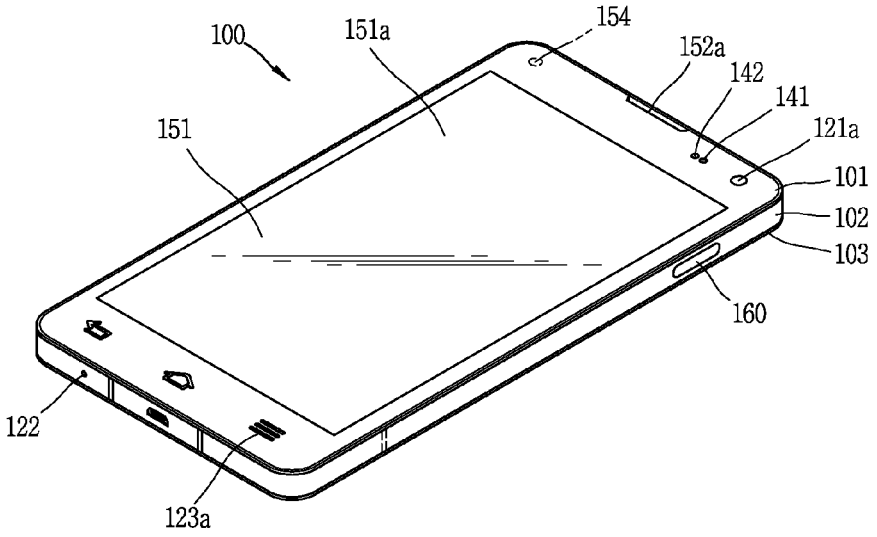
FIGS. 1B and 1C are conceptual views illustrating an example in which a mobile terminal associated with the present disclosure is seen from different directions.
Figure 1C:
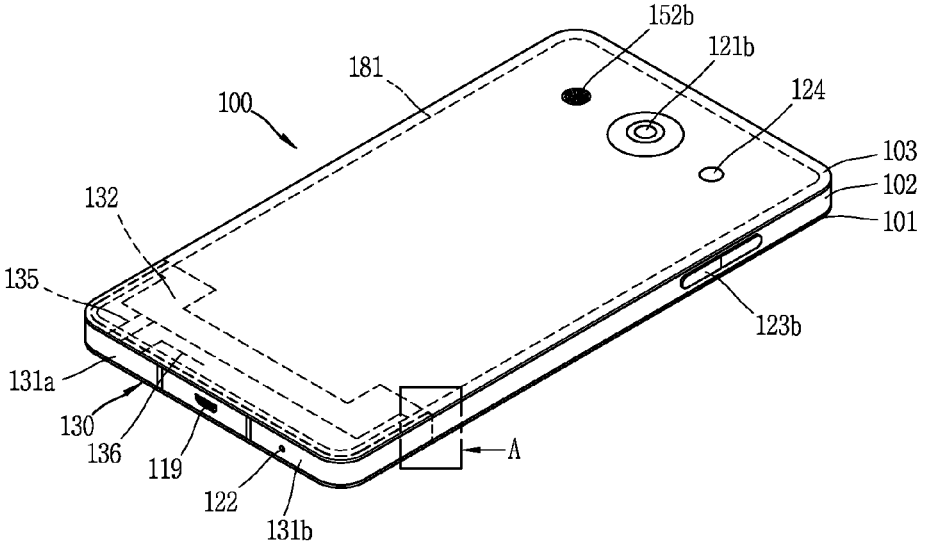

Referring to FIGS. 1A through 1C, FIG. 1A is a block diagram of a mobile terminal in accordance with the present disclosure, FIGS. 1B and 1C are conceptual views of one example of the mobile terminal, viewed from different directions.

The mobile terminal 100 may include components, such as a wireless communication unit 110, an input unit 120, a sensing unit 140, an output unit 150, an interface unit 160, a memory 170, a controller 180, a power supply unit 190 and the like. FIG. 1A illustrates the mobile terminal having various components, but it may be understood that implementing all of the illustrated components is not a requirement. Greater or fewer components may alternatively be implemented.

In more detail, the wireless communication unit 110 of those components may typically include one or more modules which permit wireless communications between the mobile terminal 100 and a wireless communication system, between the mobile terminal 100 and another mobile terminal 100, or between the mobile terminal 100 and a network within which another mobile terminal 100 (or an external server) is located.

For example, the wireless communication unit 110 may include at least one of a broadcast receiving module 111, a mobile communication module 112, a wireless Internet module 113, a short-range communication module 114, a location information module 115 and the like.

The input unit 120 may include a camera 121 for inputting an image signal, a microphone 122 or an audio input module for inputting an audio signal, or a user input unit 123 (for example, a touch key, a push key (or a mechanical key), etc.) for allowing a user to input information. Audio data or image data collected by the input unit 120 may be analyzed and processed by a user's control command.

The sensing unit 140 may include at least one sensor which senses at least one of internal information of the mobile terminal, a surrounding environment of the mobile terminal and user information. For example, the sensing unit 140 may include a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, refer to the camera 121), a microphone 122, a battery gage, an environment sensor (for example, a barometer, a hygrometer, a thermometer, a radiation detection sensor, a thermal sensor, a gas sensor, etc.), and a chemical sensor (for example, an electronic nose, a health care sensor, a biometric sensor, etc.). On the other hand, the mobile terminal disclosed herein may utilize information in such a manner of combining information sensed by at least two sensors of those sensors.

The output unit 150 may be configured to output an audio signal, a video signal or a tactile signal. The output unit 150 may include a display unit 151, an audio output module 152, a haptic module 153, an optical output module 154 and the like. The display unit 151 may have an inter-layered structure or an integrated structure with a touch sensor so as to implement a touch screen. The touch screen may provide an output interface between the mobile terminal 100 and a user, as well as functioning as the user input unit 123 which provides an input interface between the mobile terminal 100 and the user.

The interface unit 160 may serve as an interface with various types of external devices connected with the mobile terminal 100. The interface unit 160, for example, may include wired or wireless headset ports, external power supply ports, wired or wireless data ports, memory card ports, ports for connecting a device having an identification module, audio input/output (I/O) ports, video I/O ports, earphone ports, or the like. The mobile terminal 100 may execute an appropriate control associated with a connected external device, in response to the external device being connected to the interface unit 160.

The memory 170 may store a plurality of application programs (or applications) executed in the mobile terminal 100, data for operations of the mobile terminal 100, instruction words, and the like. At least some of those application programs may be downloaded from an external server via wireless communication. Some others of those application programs may be installed within the mobile terminal 100 at the time of being shipped for basic functions of the mobile terminal 100 (for example, receiving a call, placing a call, receiving a message, sending a message, etc.). On the other hand, the application programs may be stored in the memory 170, installed in the mobile terminal 100, and executed by the controller 180 to perform an operation (or a function) of the mobile terminal 100.

The controller 180 may typically control an overall operation of the mobile terminal 100 in addition to the operations associated with the application programs. The controller 180 may provide or process information or functions appropriate for a user in a manner of processing signals, data, information and the like, which are input or output by the aforementioned components, or activating the application programs stored in the memory 170.

The controller 180 may control at least part of the components illustrated in FIG. 1, in order to drive the application programs stored in the memory 170. In addition, the controller 180 may drive the application programs by combining at least two of the components included in the mobile terminal 100 for operation.

The power supply unit 190 may receive external power or internal power and supply appropriate power required for operating respective elements and components included in the mobile terminal 100 under the control of the controller 180. The power supply unit 190 may include a battery, and the battery may be an embedded battery or a replaceable battery.

At least part of those elements and components may be combined to implement operation and control of the mobile terminal or a control method of the mobile terminal according to various exemplary embodiments described herein. Also, the operation and control or the control method of the mobile terminal may be implemented in the mobile terminal in such a manner of activating at least one application program stored in the memory 170.

Referring to FIGS. 1B and 1C, the mobile terminal 100 disclosed herein may be provided with a bar-type terminal body. However, the present disclosure may not be limited to this, but also may be applicable to various structures such as watch type, clip type, glasses type or folder type, flip type, slide type, swing type, swivel type, or the like, in which two and more bodies are combined with each other in a relatively movable manner.

Here, the terminal body may be understood as a conception which indicates the mobile terminal 100 as at least one assembly.

The mobile terminal 100 may include a case (casing, housing, cover, etc.) forming the appearance of the terminal. In this embodiment, the case may be divided into a front case 101 and a rear case 102. Various electronic components may be incorporated into a space formed between the front case 101 and the rear case 102. At least one middle case may be additionally disposed between the front case 101 and the rear case 102

A display unit 151 may be disposed on a front surface of the terminal body to output information. As illustrated, a window 151*a* of the display unit 151 may be mounted to the front case 101 so as to form the front surface of the terminal body together with the front case 101.

In some cases, electronic components may also be mounted to the rear case 102. Examples of those electronic components mounted to the rear case 102 may include a detachable battery, an identification module, a memory card and the like. Here, a rear cover 103 for covering the electronic components mounted may be detachably coupled to the rear case 102. Therefore, when the rear cover 103 is detached from the rear case 102, the electronic components mounted to the rear case 102 may be externally exposed.

As illustrated, when the rear cover 103 is coupled to the rear case 102, a side surface of the rear case 102 may be partially exposed. In some cases, upon the coupling, the rear case 102 may also be completely shielded by the rear cover 103. On the other hand, the rear cover 103 may include an opening for externally exposing a camera 121*b* or an audio output module 152*b*.

The cases 101, 102, 103 may be formed by injection-molding synthetic resin or may be formed of a metal, for example, stainless steel (STS), titanium (Ti), or the like.

Unlike the example which the plurality of cases form an inner space for accommodating such various components, the mobile terminal 100 may be configured such that one case forms the inner space. In this example, a mobile terminal 100 having a uni-body formed in such a manner that synthetic resin or metal extends from a side surface to a rear surface may also be implemented.

On the other hand, the mobile terminal 100 may include a waterproofing unit (not shown) for preventing an introduction of water into the terminal body. For example, the waterproofing unit may include a waterproofing member which is located between the window 151*a* and the front case 101, between the front case 101 and the rear case 102, or between the rear case 102 and the rear cover 103, to hermetically seal an inner space when those cases are coupled.

The mobile terminal may include a display unit 151, first and second audio output modules 152*a* and 152*b*, a proximity sensor 141, an illumination sensor 152, an optical output module 154, first and second cameras 121*a* and 121*b*, first and second manipulation units 123*a* and 123*b*, a microphone 122, an interface unit 160 and the like.

Hereinafter, description will be given of an exemplary mobile terminal 100 that the display unit 151, the first audio output module 152*a*, the proximity sensor 141, the illumination sensor 142, the optical output module 154, the first camera 121*a* and the first manipulation unit 123*a* are disposed on the front surface of the terminal body, the second manipulation unit 123*b*, the microphone 122 and the interface unit 160 are disposed on a side surface of the terminal body, and the second audio output module 152*b* and the second camera 121*b* are disposed on a rear surface of the terminal body, with reference to FIGS. 1B and 1C.

Here, those components may not be limited to the arrangement, but be excluded or arranged on another surface if necessary. For example, the first manipulation unit 123*a* may not be disposed on the front surface of the terminal body, and the second audio output module 152*b* may be disposed on the side surface other than the rear surface of the terminal body.

The display unit 151 may output information processed in the mobile terminal 100. For example, the display unit 151 may display execution screen information of an application program driven in the mobile terminal 100 or user interface (UI) and graphic user interface (GUI) information in response to the execution screen information.

The display unit 151 may include at least one of a liquid crystal display (LCD), a thin film transistor-liquid crystal display (TFT-LCD), an organic light emitting diode (OLED), a flexible display, a 3-dimensional (3D) display, and an e-ink display.

The display unit 151 may be implemented in two or more in number according to a configured aspect of the mobile terminal 100. For instance, a plurality of the display units 151 may be arranged on one surface to be separated from or integrated with each other, or may be arranged on different surfaces.

The display unit 151 may include a touch sensor which senses a touch onto the display unit so as to receive a control command in a touching manner. When a touch is input to the display unit 151, the touch sensor may be configured to sense this touch and the controller 180 may generate a control command corresponding to the touch. The content which is input in the touching manner may be a text or numerical value, or a menu item which can be indicated or designated in various modes.

The touch sensor may be configured in a form of film having a touch pattern. The touch sensor may be a metal wire, which is disposed between the window 151*a* and a display (not shown) on a rear surface of the window 151*a* or patterned directly on the rear surface of the window 151*a*. Or, the touch sensor may be integrally formed with the display. For example, the touch sensor may be disposed on a substrate of the display or within the display.

The display unit 151 may form a touch screen together with the touch sensor. Here, the touch screen may serve as the user input unit 123 (see FIG. 1A). Therefore, the touch screen may replace at least some of functions of the first manipulation unit 123*a*.

The first audio output module 152*a* may be implemented in the form of a receiver for transferring voice sounds to the user's ear or a loud speaker for outputting various alarm sounds or multimedia reproduction sounds.

The window 151*a* of the display unit 151 may include a sound hole for emitting sounds generated from the first audio output module 152*a*. Here, the present disclosure may not be limited to this. It may also be configured such that the sounds are released along an assembly gap between the structural bodies (for example, a gap between the window 151*a* and the front case 101). In this case, a hole independently formed to output audio sounds may not be seen or hidden in terms of appearance, thereby further simplifying the appearance of the mobile terminal 100.

The optical output module 154 may output light for indicating an event generation. Examples of the event generated in the mobile terminal 100 may include a message reception, a call signal reception, a missed call, an alarm, a schedule notice, an email reception, information reception through an application, and the like. When a user's event checking is sensed, the controller may control the optical output unit 154 to stop the output of the light.

The first camera 121*a* may process video frames such as still or moving images obtained by the image sensor in a video call mode or a capture mode. The processed video frames may be displayed on the display unit 151 or stored in the memory 170.

The first and second manipulation units 123*a* and 123*b* are examples of the user input unit 123, which may be manipulated by a user to input a command for controlling the operation of the mobile terminal 100. The first and second manipulation units 123*a* and 123*b* may also be commonly referred to as a manipulating portion, and may employ any method if it is a tactile manner allowing the user to perform manipulation with a tactile feeling such as touch, push, scroll or the like.

The drawings are illustrated on the basis that the first manipulation unit 123*a* is a touch key, but the present disclosure may not be necessarily limited to this. For example, the first manipulation unit 123*a* may be configured with a mechanical key, or a combination of a touch key and a push key.

The content received by the first and second manipulation units 123*a* and 123*b* may be set in various ways. For example, the first manipulation unit 123*a* may be used by the user to input a command such as menu, home key, cancel, search, or the like, and the second manipulation unit 123*b* may be used by the user to input a command, such as controlling a volume level being output from the first or second audio output module 152*a* or 152*b*, switching into a touch recognition mode of the display unit 151, or the like.

On the other hand, as another example of the user input unit 123, a rear input unit (not shown) may be disposed on the rear surface of the terminal body. The rear input unit may be manipulated by a user to input a command for controlling an operation of the mobile terminal 100. The content input may be set in various ways. For example, the rear input unit may be used by the user to input a command, such as power on/off, start, end, scroll or the like, controlling a volume level being output from the first or second audio output module 152*a* or 152*b*, switching into a touch recognition mode of the display unit 151, or the like. The rear input unit may be implemented into a form allowing a touch input, a push input or a combination thereof.

The rear input unit may be disposed to overlap the display unit 151 of the front surface in a thickness direction of the terminal body. As one example, the rear input unit may be disposed on an upper end portion of the rear surface of the terminal body such that a user can easily manipulate it using a forefinger when the user grabs the terminal body with one hand. However, the present disclosure may not be limited to this, and the position of the rear input unit may be changeable.

When the rear input unit is disposed on the rear surface of the terminal body, a new user interface may be implemented using the rear input unit. Also, the aforementioned touch screen or the rear input unit may substitute for at least part of functions of the first manipulation unit 123*a* located on the front surface of the terminal body. Accordingly, when the first manipulation unit 123*a* is not disposed on the front surface of the terminal body, the display unit 151 may be implemented to have a larger screen.

On the other hand, the mobile terminal 100 may include a finger scan sensor which scans a user's fingerprint. The controller may use fingerprint information sensed by the finger scan sensor as an authentication means. The finger scan sensor may be installed in the display unit 151 or the user input unit 123.

The microphone 122 may be formed to receive the user's voice, other sounds, and the like. The microphone 122 may be provided at a plurality of places, and configured to receive stereo sounds.

The interface unit 160 may serve as a path allowing the mobile terminal 100 to exchange data with external devices. For example, the interface unit 160 may be at least one of a connection terminal for connecting to another device (for example, an earphone, an external speaker, or the like), a port for near field communication (for example, an Infrared Data Association (IrDA) port, a Bluetooth port, a wireless LAN port, and the like), or a power supply terminal for supplying power to the mobile terminal 100. The interface unit 160 may be implemented in the form of a socket for accommodating an external card, such as Subscriber Identification Module (SIM), User Identity Module (UIM), or a memory card for information storage.

The second camera 121*b* may be further mounted to the rear surface of the terminal body. The second camera 121*b* may have an image capturing direction, which is substantially opposite to the direction of the first camera unit 121*a*.

The second camera 121*b* may include a plurality of lenses arranged along at least one line. The plurality of lenses may also be arranged in a matrix configuration. The cameras may be referred to as an 'array camera.' When the second camera 121*b* is implemented as the array camera, images may be captured in various manners using the plurality of lenses and images with better qualities may be obtained.

A flash 124 may be disposed adjacent to the second camera 121*b*. When an image of a subject is captured with the camera 121*b*, the flash 124 may illuminate the subject.

The second audio output module 152*b* may further be disposed on the terminal body. The second audio output module 152*b* may implement stereophonic sound functions in conjunction with the first audio output module 152*a* (refer to FIG. 1A), and may be also used for implementing a speaker phone mode for call communication.

At least one antenna for wireless communication may be disposed on the terminal body. The antenna may be installed in the terminal body or formed on the case. For example, an antenna which configures a part of the broadcast receiving module 111 (see FIG. 1A) may be retractable into the terminal body. Alternatively, an antenna may be formed in a form of film to be attached onto an inner surface of the rear cover 103 or a case including a conductive material may serve as an antenna.

A power supply unit 190 for supplying power to the mobile terminal 100 may be disposed on the terminal body. The power supply unit 190 may include a batter 191 which is mounted in the terminal body or detachably coupled to an outside of the terminal body.

The battery 191 may receive power via a power source cable connected to the interface unit 160. Also, the battery 191 may be (re)chargeable in a wireless manner using a wireless charger. The wireless charging may be implemented by magnetic induction or electromagnetic resonance.

On the other hand, the drawing illustrates that the rear cover 103 is coupled to the rear case 102 for shielding the battery 191, so as to prevent separation of the battery 191 and protect the battery 191 from an external impact or foreign materials. When the battery 191 is detachable from the terminal body, the rear case 103 may be detachably coupled to the rear case 102.

An accessory for protecting an appearance or assisting or extending the functions of the mobile terminal 100 may further be provided on the mobile terminal 100. As one example of the accessory, a cover or pouch for covering or accommodating at least one surface of the mobile terminal 100 may be provided. The cover or pouch may cooperate with the display unit 151 to extend the function of the mobile terminal 100. Another example of the accessory may be a touch pen for assisting or extending a touch input onto a touch screen.

Hereinafter, embodiments associated with a control method which can be implemented in the mobile terminal having the foregoing configuration will be described with reference to the attached drawings. It should be understood by those skilled in the art that the present invention can be embodied in other specific forms without departing from the concept and essential characteristics thereof.

Figure 2A:
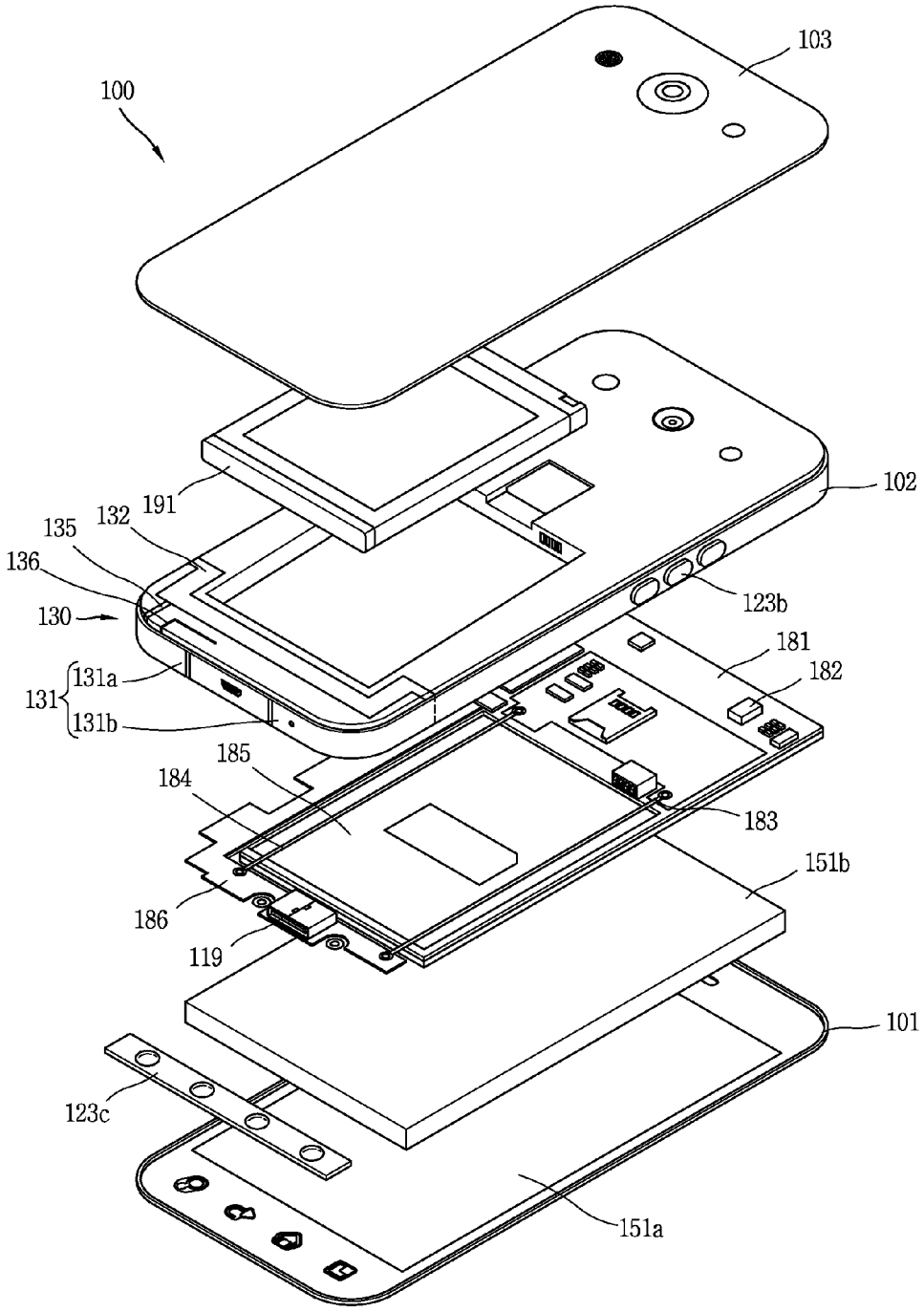
FIGS. 2A, 2B, 2C and 2D are exploded perspective views illustrating a mobile terminal associated with an embodiment of the present disclosure.
Figure 2B:
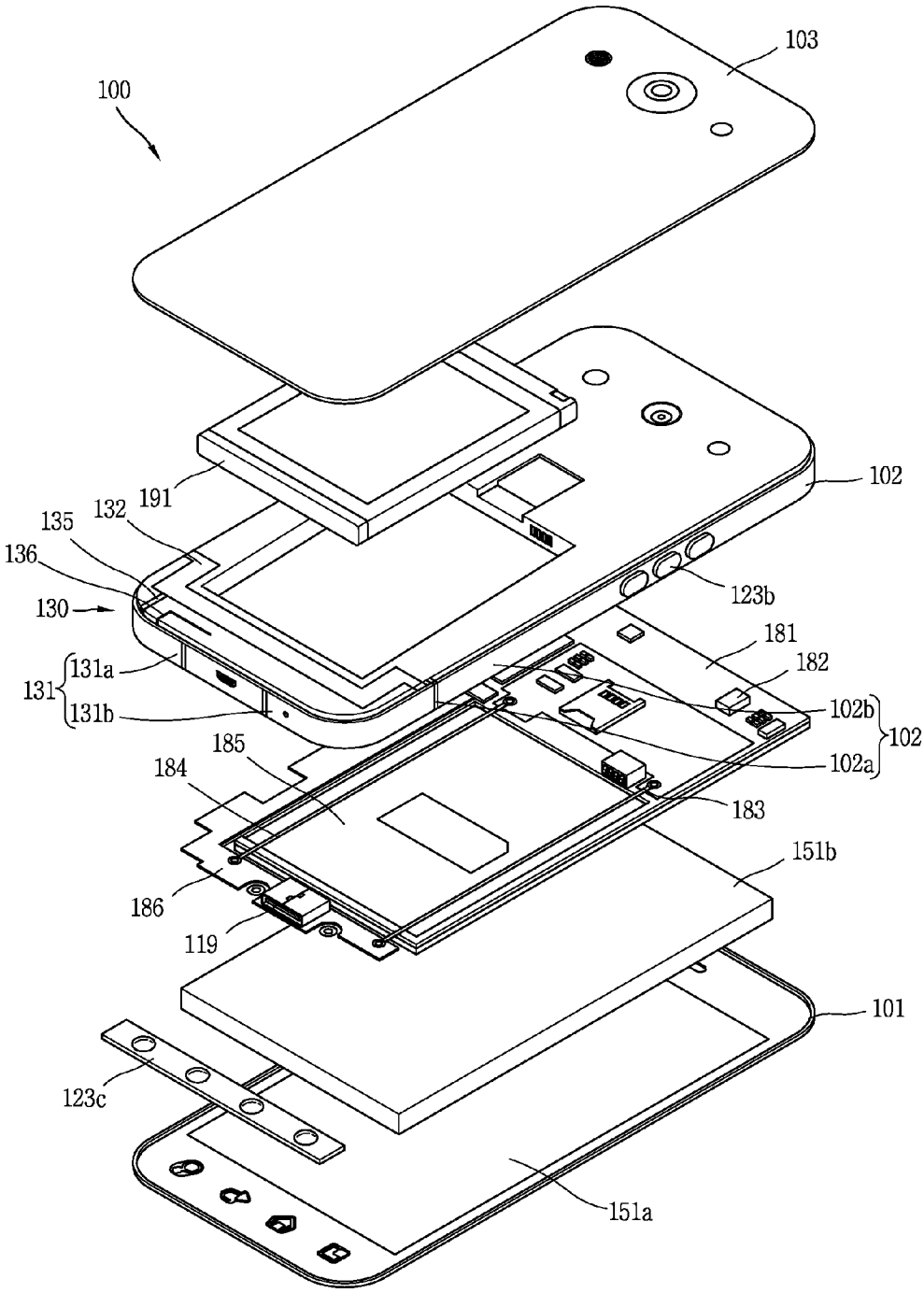
Figure 2C:
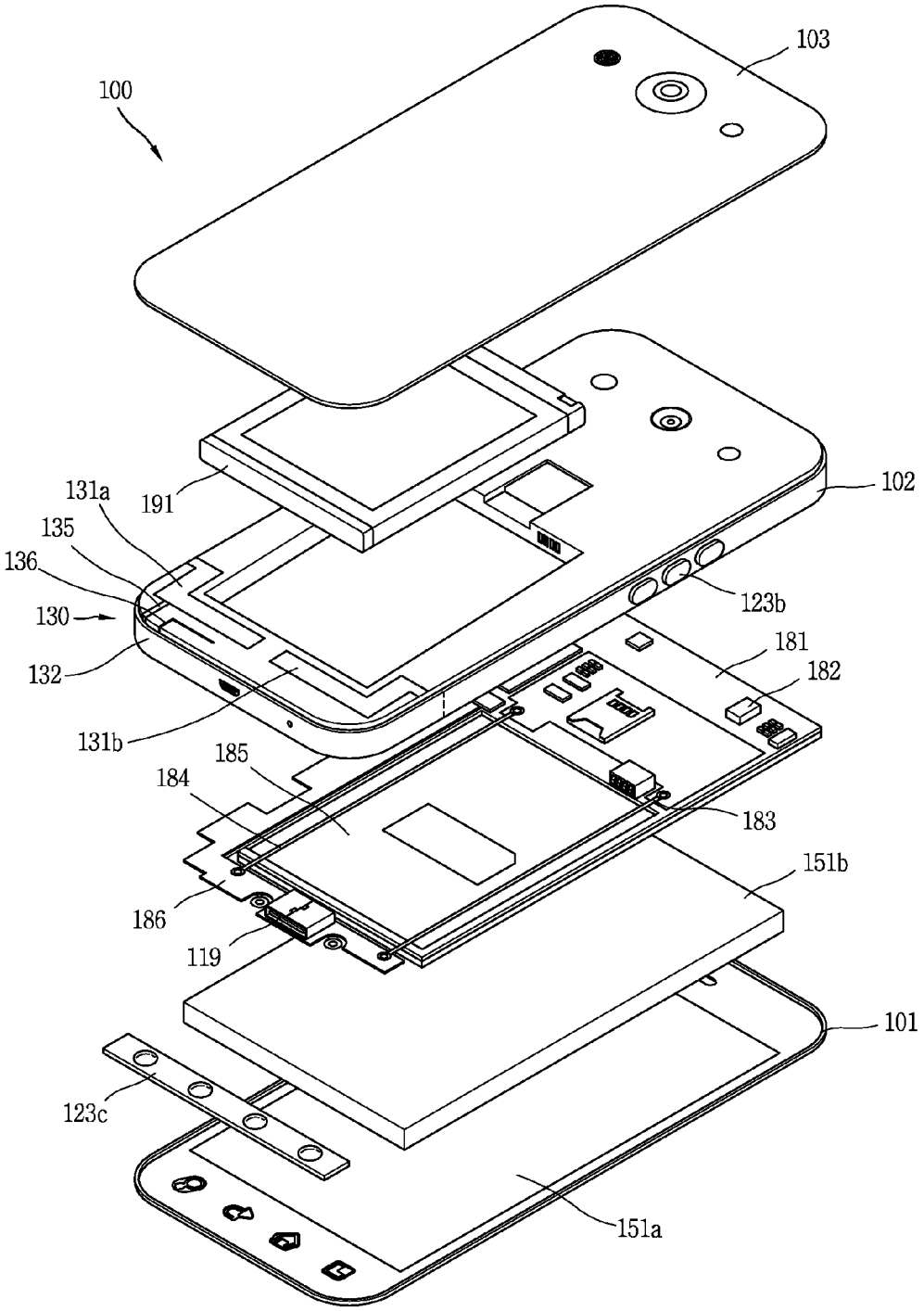
Figure 2D:
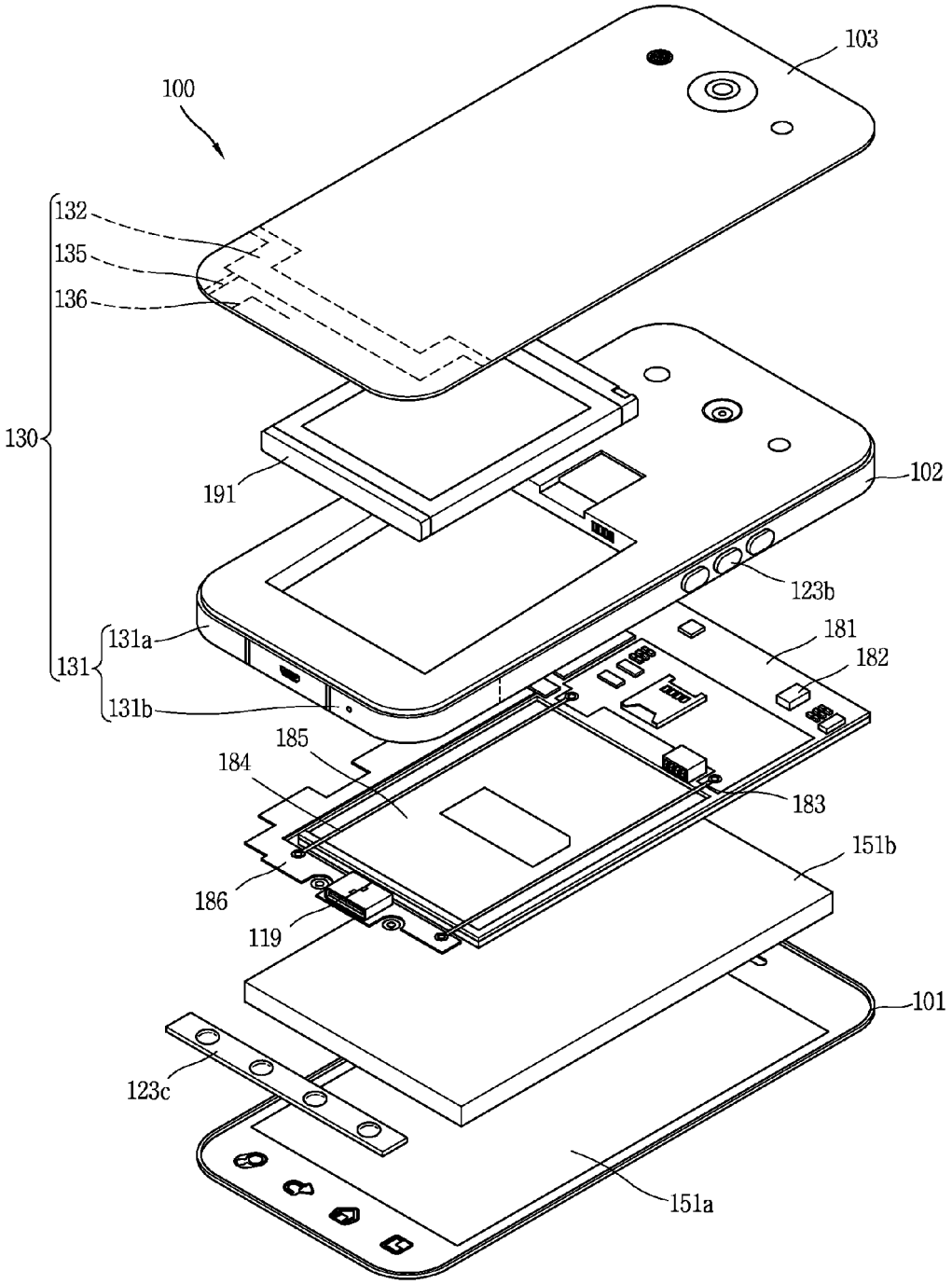

First, FIGS. 2A through 2D are exploded perspective views illustrating a mobile terminal associated with an embodiment of the present disclosure, and will be described below with reference to FIGS. 2A and 2D.

The mobile terminal may include a window 151*a* and a display module 151*b* constituting the display unit 151. The window 151*a* may be coupled to one surface of the front case 101.

A frame 185 is formed to support electrical elements between the front case 101 and the rear case 102. As a supporting structure within the terminal, the frame 185 is formed to support at least any one of the display module 151*b*, camera module 121*b*, antenna module 130, battery 191 and circuit board 181 as an example.

Part of the frame 185 may be exposed to the outside of the terminal. Furthermore, the frame 185 may form part of a sliding module for connecting the body portion with the display unit in a slide type terminal other than a bar type terminal.

The drawings of FIGS. 2A through 2D illustrate an example in which the frame 185 is disposed between the rear case 102 and the circuit board 181, and the display module 151*b* is coupled to one surface of the circuit board 181. A rear cover 103 may be coupled to the rear case 102 to cover the battery 191. Here, the frame 185 is a component for enhancing the rigidity of the mobile terminal.

The window 151*a* is coupled to one surface of the front case 101. A touch sensor (not shown) may be mounted on the window 151*a*. The touch sensor is formed to sense a touch input, and made of a light transmitting material. The touch sensor is mounted on a front surface of the window 151*a*, and configured to convert a change of voltage or the like generated at a specific portion of the window 151*a* into an electrical input signal.

The display module 151*b* is mounted on a rear surface of the window 151*a*. As an example of the display module 151*b*, the present embodiment discloses a thin film transistor liquid crystal display (TFT LCD), but the present disclosure may not be necessarily limited to this.

For example, the display module 151*b* may be a liquid crystal display (LCD), an organic light-emitting device (OLED), a flexible display, a three-dimensional (3D) display or the like.

The circuit board 181 may be mounted at a lower portion of the display module 151*b*. Furthermore, at least one electrical element may be mounted on a lower surface of the circuit board 181.

A recessed type of receiving portion may be formed on the frame 185 to accommodate the battery 191. A contact terminal connected to the circuit board 181 may be formed at one lateral surface of the rear case 102 or frame 185 to allow the battery 191 to supply power to the terminal body.

An antenna module may be formed at an upper end or lower end of the mobile terminal.

In general, a LTE/WCDMA Rx only antenna, a GPS antenna, a BT/WiFi antenna or the like may be used at an upper end of the mobile terminal, and a main antenna is used at a lower end of the mobile terminal.

An embodiment of the present disclosure relates to a main antenna, but may not be necessarily limited to this, and may transmit and receive at least one or more band frequencies of the LTE/WCDMA Rx only antenna, GPS antenna, BT/WiFi antenna based on its frequency band.

Furthermore, the foregoing antenna module may be formed in a plural number to be disposed at each end portion of the terminal, and each antenna module may be formed to transmit and receive wireless signals having different band frequencies.

The frame 185 may be formed of a metal material to maintain sufficient rigidity even if formed with a low thickness. The frame 185 with a metal material may be operated as ground. In other words, the circuit board 181 or antenna module 130 may be ground connected to the frame 185, and the frame 185 may be operated as the ground of the circuit board 181 or antenna module 130. In this case, the frame 185 may extend the ground of the mobile terminal.

Here, when the circuit board 181 is formed to occupy most area of the terminal body without being provided with the frame 185, the ground may be extended with the circuit board 181 itself.

The circuit board 181 may be electrically connected to the antenna module 130, and configured to process wireless signals (or wireless electromagnetic waves) transmitted and received by the antenna module 130. A plurality of transmitting and receiving circuits 182 may be formed or mounted on the circuit board 181 to process wireless signals.

The transmitting and receiving circuits may be formed to include one or more integrated circuits and their related electrical elements. For an example, a transmitting and receiving circuit may include a transmitting integrated circuit, a receiving integrated circuit, a switching circuit, an amplifier and the like.

A plurality of transmitting and receiving circuits may concurrently feed conductive members, which are radiators, to operate a plurality of antenna modules 130 at the same time. For example, while either one transmits signals, the other one may receive signals, and both ones transmit and receive signals.

The transmitting and receiving circuit may be formed in a plural number, and each transmitting and receiving circuit may be implemented in the form of a communication chip including at least one of a call processor CP), a modem chip, a RF transceiver chip and a RF receiver chip. Due to this, each communication chip may feed a conductive member through a feeding portion and a matching module (including a variable switch) to transmit wireless signals or receive wireless receiving signals received by the conductive member through the matching module (including a variable switch) and feeding portion so as to execute a predetermined receiving processing such as frequency conversion processing, demodulation processing or the like.

A coaxial cable 183, 184 connects the circuit board 181 and each antenna module 130 to each other. For an example, the coaxial cable 183, 184 may be connected to a feeding device for feeding the antenna module 130. The feeding devices may be formed on one surface of a flexible circuit board 186 formed to process signals received from the manipulation unit 123*a*. The other surface of the flexible circuit board 186 may be coupled to a signal transfer unit 123*c* formed to transfer a signal of the manipulation unit 123*a*. In this case, a dome is formed on the other surface of the flexible circuit board 186, and an actuator may be formed on the signal transfer unit 123*c*.

Furthermore, according to an embodiment of the present disclosure, there is provided an antenna module 130 for utilizing a metal edge forming an external appearance of the mobile terminal. For example, part or all of a lateral surface forming an external appearance of the mobile terminal may be used as an antenna.

Figure 3:
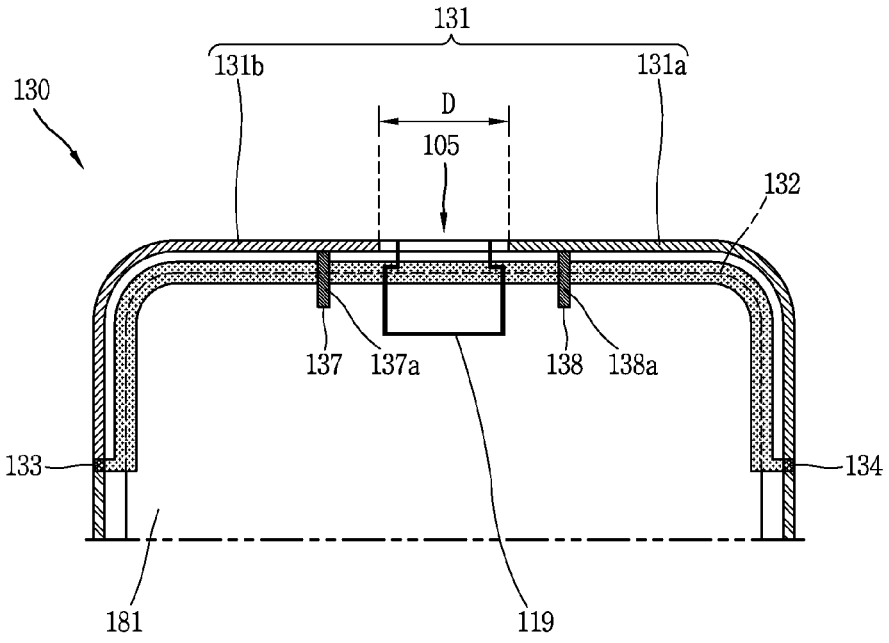
FIG. 3 is a plan view illustrating an antenna module according to a first embodiment of the present disclosure.

Hereinafter, a first embodiment of the present disclosure will be described with reference to FIGS. 2A through 2D and 3. FIG. 3 is a plan view illustrating an antenna module 130 according to a first embodiment of the present disclosure as a view illustrating the antenna module 130 in FIG. 2A. However, FIGS. 2B through 2D may be substantially analyzed as FIG. 3 though partially different from the mobile terminal illustrated in FIG. 2A, and thus FIG. 3 will be understood and described below as a plan view of FIGS. 2A through 2D.

The antenna module 130 according to a first embodiment of the present disclosure may include a first conductive member 131 connected to a feeding portion 137 and a grounding portion 138, a second conductive member 132 disposed to be separated from the first conductive member 131, a first connecting member 133 configured to connect the first conductive member 131 to the second conductive member 132 at a position adjacent to the feeding portion 137, and a second connecting member 134 configured to connect the first conductive member 131 to the second conductive member 132 at a position adjacent to the grounding portion 138. Here, the feeding portion 137 and grounding portion 138 may be separated from each other by a predetermined distance along the formation direction of the first and the second conductive member 131, 132.

Here, the first conductive member 131 and second conductive member 132 may operate as a radiator of the antenna module 130, and the first conductive member 131 and second conductive member 132 may operate as a radiator of a folded dipole antenna. Furthermore, the first conductive member 131 and second conductive member 132 may be formed with a metal pattern, and may be a microstrip, for an example.

An input resistance of the folded dipole antenna is larger than that of a half-wave dipole antenna by about four times, and thus the radiation power and radiation resistance thereof increases when compared to those of a typical half-wave dipole antenna. Accordingly, matching to a feeding line having a large characteristic impedance may be facilitated, thereby implementing broadband characteristics.

Furthermore, the first conductive member 131 and second conductive member 132 may be disposed adjacent to the circuit board 181, and at least part of the second conductive member 132 may be disposed to overlap with the circuit board 181.

As a portion of supplying a current to each member being operated as a radiator, a feeding portion according to an embodiment of the present disclosure may be formed with a combination of a balun, a shifter, a divider, an attenuator, an amplifier, and the like. It will be the same for all feeding portions 137, 237*a*, 237*b* which will be described below.

A feeding method to the conductive member 131, 132 according to an embodiment of the present disclosure may not be limited in particular. For example, the feeding portion 137 to the first conductive member 131 or second conductive member 132 may be electrically connected or the conductive member may be fed in an electro-magnetic feeding method. However, according to a first and a second embodiment of the present disclosure, interference may occur between the first conductive member 131, 231 and the second conductive member 132, 232 in a small space, and thus feeding to the conductive member 131, 132, 231, 232 may be preferably provided with direct feeding due to a feeding line.

Accordingly, it will be described based on feeding with a direct feeding method. For the purpose of such feeding, the feeding line 137*a* may include at least one of a feeding plate, a clip for feeding and a feeding line. Here, the feeding plate, clip for feeding or feeding line are electrically connected to one another to transfer a current (or voltage) fed through the feeding device to conductive members for transmitting and receiving wireless signals. Here, feeding line may include a microstrip printed on a substrate.

Here, the first conductive member 131 may be divided into a first portion 131*a* and a second portion 131*b*, and the first portion 131*a* and second portion 131*b* are separated from each other by a predetermined distance (D) to form a slit 105, and the slit 105 is formed between the feeding portion 137 and the grounding portion 138. In this manner, according to a first embodiment of the present disclosure, the slit 105 is formed on the first conductive member 131, and it is to shorten the length of the first conductive member 131, thereby more easily implementing a frequency having a high frequency band. Here, it is preferable that the slit 105 is sufficiently spaced apart not to cause electrical coupling between the first portion 131*a* and the second portion 131*b*. If electrical coupling occurs between the first portion 131*a* and second portion 131*b*, it may be difficult to implement a resonant frequency with a low or high frequency band, and thus the first portion 131*a* and second portion 131*b* should be spaced apart to the extent that coupling does not occur.

FIG. 2A relates to a first embodiment of the present disclosure in which the first conductive member 131 forms a lateral appearance of the terminal body, and the second conductive member 132 is formed on the rear case 102. Here, the first conductive member 131 may form part or all of a lateral appearance of the terminal body, and maintain the integrity of an appearance design when all of a lateral surface of the terminal body is formed. However, here, the first and the second connecting member 133, 134 is connected to the first and the second conductive member 131, 132 such that the antenna module 130 is electrically isolated from the remaining portion 102*b* (refer to FIG. 2B) excluding the first conductive member 131.

FIG. 2B illustrates a case where the first conductive member 131 forms part of a lateral appearance of the terminal body, and is separated from the remaining portion 102*b* by an insulating material 102*a*, wherein it is grounded to the circuit board 181 at one position of the remaining portion 102*b*. Here, the remaining portion 102*b* may be a metal deco. The remaining portion 102*b* may form the rear case 102 along with the first conductive member 131 or second conductive member 132. In other words, the remaining portion 102*b* may be connected to the first conductive member 131 (second conductive member 132 when the first conductive member 131 is formed on the rear case 102 and the second conductive member 132 forms a lateral appearance of the terminal body) to form a lateral appearance of the terminal body.

Here, the remaining portion 102*b* may be formed in a loop shape connected to the first conductive member 131, and formed as the rear case 102 formed into an integral body by insert molding. It is similar to the other embodiments if it is not limited in particular.

Furthermore, FIG. 2C relates to a first embodiment of the present disclosure, and illustrates a case where the formation positions of the first conductive member 131 and second conductive member 132 are changed with each other, contrary to the case of FIGS. 2A and 2B, and they are the same as in the case of FIGS. 2A and 2B excluding that the positions of the first conductive member 131 and second conductive member 132 are changed. In other words, according to a first embodiment of the present disclosure, the first conductive member 131 and second conductive member 132 may be formed anywhere on a lateral appearance of the terminal body or within the terminal body, and it is sufficient when the slit 105 is formed on either one of the first conductive member 131 and second conductive member 132, and spaced apart by a predetermined distance.

FIG. 2D relates to a first embodiment of the present disclosure, and illustrates that the second conductive member 132, third connecting member 135 and sub-arm 136 are formed on the rear cover 103. In other words, it is illustrated that the first conductive member 131 forms part or all of a lateral appearance of the terminal body, and the second conductive member 132 is mounted on an inner side of the rear cover 103. Here, the sub-arm 136 performs a branch function for parasitic resonance.

In this manner, either one of the first conductive member 131 and second conductive member 132 may form part or all of a lateral appearance of the mobile terminal, and the first conductive member 131 or second conductive member 132, the third connecting member 135 and sub-arm 136 may be formed on the rear cover 103 or formed on the rear case 102. Moreover, the first conductive member 131 or second conductive member 132 may be formed on an inner surface or outer surface of the rear case 102, and may not be necessarily formed on the outermost even when forming a lateral surface of the terminal body. For example, the first conductive member 131 may be formed on a lateral surface of the terminal body, but an injection-molded article may be formed on a lateral surface of the outermost, and the first conductive member 131 may be formed within the injection mold.

In other words, according to a first embodiment of the present disclosure, it is sufficient that the first conductive member 131 and second conductive member 132 are spaced apart by a predetermined distance, and may not necessarily form an external appearance of the terminal body.

The feeding portion 137 may feed the first conductive member 131 to form an antenna loop having various lengths. Due to such a configuration, it may be possible to implement a frequency having a low and a high frequency band.

The drawings of FIGS. 2A through 2D are only one example, and thus may be redundantly applied a different embodiment if it is not limited in particular. It is similar to a second embodiment. For example, the first conductive member 231 in the second embodiment may form part of all of an lateral appearance of the terminal body, and the second conductive member 232 may be disposed within the terminal body.

The circuit board 181 may be a flexible circuit board, and the board may be a dielectric substrate or semiconductor substrate, and the ground may be formed on either one surface of the substrate, and any one layer may be the ground when the substrate is a multi-layer substrate. Furthermore, the first and the second conductive member 131, 132 according to an embodiment of the present disclosure is cut along the circuit board 181 to correspond to the structure of the terminal body.

Figure 4A:
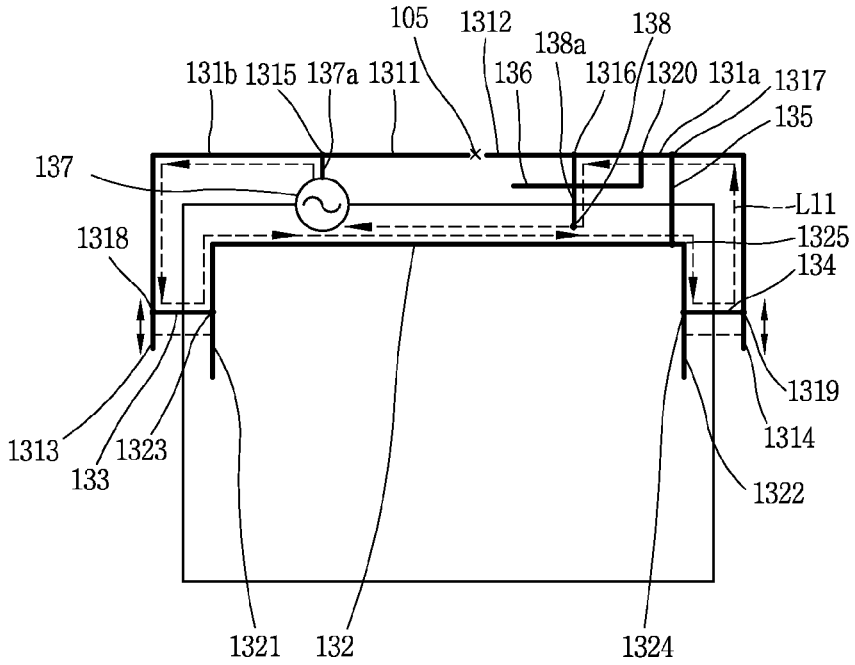
FIGS. 4A, 4B, 4C, 4D, 4E and 4F are resonant paths of a resonant frequency in a first embodiment of the present disclosure.

FIG. 4 is a resonant path of a resonant frequency in a first embodiment of the present disclosure, and FIG. 4A illustrates a first resonant path (L11) capable of implementing a first resonant frequency (F11), wherein the first resonant path (L11) is formed by a current flowing through the first conductive member 131, second conductive member 132, first connecting member 133 and second connecting member 134. Here, the first portion 131*a* and second portion 131*b* are formed to be spaced apart, and thus the resonant path may include a path connected to the feeding portion 137 and grounding portion 138. It is the same on all resonant paths in a first embodiment described below.

According to a first embodiment of the present disclosure, a position 1318 at which the first connecting member 133 is connected to the first conductive member 131 varies between a portion 1315 connected to the feeding portion 137 and an end of the first conductive member 131 on the first conductive member 131. A position at which the first connecting member 133 is connected to the second conductive member 132 may not be limited in particular, but may be preferably connected to the nearest portion 1323 to the first conductive member 131. It is because the first connecting member 133 may be a screw, a C-clip, a pogo pin, an EMI sheet, or the like as will be described later. The first conductive member 131 may be connected to the second conductive member 132 by a conductive pattern, and in this case, the first connecting member 133 may not be formed at a recent contact point between the first conductive member 131 and second conductive member 132.

It is similar to a case of the second connecting member 134 and third connecting member 135 which will be described later. FIGS. 2A through 2D illustrate a case where the third connecting member 135 is a conductive pattern.

Furthermore, a position at which the second connecting member 134 is connected to the first conductive member 131 varies between a portion 1316 connected to the grounding portion 138 through a grounding line 138*a* on the first conductive member 131 and an end of the first conductive member 131.

Furthermore, the frequency band may vary by varying the formation positions of the first connecting member 133 and second connecting member 134. In other words, as illustrated in FIG. 4A, the first connecting member 133 may be formed at an end of the first conductive member 131 and/or second conductive member 132, and formed at any one position of the middle portion thereof. When formed at any one position of the middle portion of the first conductive member 131 and/or second conductive member 132, a first through a fourth parasitic arm 1313, 1314, 1321, 1322 may be formed. In this manner, the first connecting member 133 and second connecting member 134 may be minutely moved to tune the frequency. Moreover, the efficiency and impedance characteristics of frequency band may be determined by the first through the fourth parasitic arm 1313, 1314, 1321, 1322. Here, the first through the fourth parasitic arm 1313, 1314, 1321, 1322 denote a portion passing through the first and the second connecting member 133, 134.

Figure 4B:
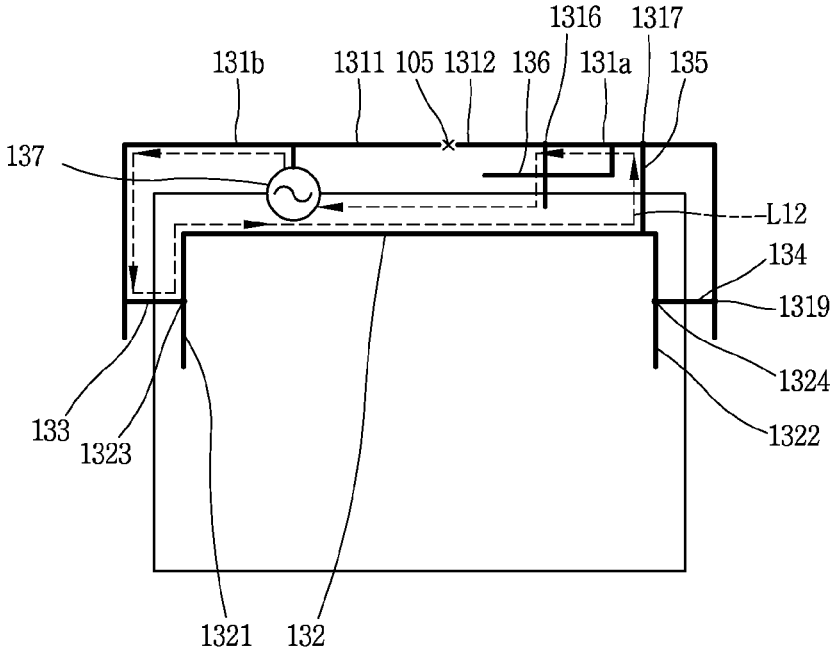

Furthermore, FIG. 4B illustrates a second resonant path (L12) capable of implementing a second resonant frequency (F12), wherein the second resonant frequency (F12) is higher than the first resonant frequency (F11). The second resonant frequency (F12) is formed along the first conductive member 131, second conductive member 132, first connecting member 133 and third connecting member 135.

In order to implement a higher resonant frequency, a shorter resonant path is required. According to a first embodiment of the present disclosure, in order to implement the second resonant frequency (F12), the third connecting member 135 is formed to implement the second resonant path (L12).

In other words, according to the antenna module 130 in an embodiment of the present disclosure, one end portion thereof may be connected to the first conductive member 131, and the other end portion thereof may further include the third connecting member 135 connected to the second conductive member 132. Here, a position 1317 at which the third connecting member 135 is connected to the first conductive member 131 varies between a portion 1316 connected to the grounding portion 138 through a grounding line 138*a* and a portion 1319 connected to the second connecting member 134 on the first conductive member 131, and a position 1325 at which the third connecting member 135 is connected to the second conductive member 132 varies between a portion 1323 connected to the first connecting member 133 and a portion 1324 connected to the second connecting member 134 on the second conductive member 132. However, it may be preferably formed adjacent to the portion 1324 connected to the second connecting member 134. If a position 1325 connected to the first connecting member 133 is formed adjacent to a portion 1323 connected to the first connecting member 133 on the second conductive member 132, a resonant length thereof may be changed to change the resonant frequency. However, a slight change in position may be allowed to obtain a required resonant frequency.

The second resonant path (L12) is formed with a path flowing between the feeding portion 137 and the grounding portion 138 due to the effect of the slit 105 formed on the first conductive member 131, similarly to the first resonant path (L11).

On the other hand, the antenna module 130 according to an embodiment of the present disclosure is a type of folded dipole antenna, and thus the first conductive member 131 and second conductive member 132 may be formed with a predetermined length to resonate at a first and a second frequency, an antenna length of the resonance may be formed to have a length of about λ/2 corresponding to a first and a second frequency. However, as will be described later, it has a length of about λ/4 when operated as a monopole antenna. Here, the first frequency is a low frequency, and the second frequency is a high frequency which is higher than the first frequency, wherein the first frequency may be a frequency band of about 700 through subject 1200 MHz which is a low frequency band, and the second frequency may be a frequency band of about 1710 through subject 27000 MHz which is a high frequency band. However, when more minutely divided, it may be also divided into a low frequency band of about 700 through 1000 MHz, a mid frequency band of 1700 through 2200 MHz, and a high frequency band of 2200 through 2700 MHz.

When the flow of a current is taken into consideration with reference to FIG. 4A again, a current fed to the first conductive member 131 is transferred to the second conductive member 132 through the first connecting member 133. A current transferred to the second conductive member 132 flows to the first conductive member 131 again through the second connecting member 1340, and then enters the ground of the circuit board 181 through the grounding portion 138.

When the antenna module 130 is seen from a different point of view based on the flow of such a current, it may be simplified to a current flowing to the first conductive member 131 and second conductive member 132 in the same direction. In other words, the antenna module 130 of the present disclosure may function as a folded dipole antenna having a shape in which a folded portion is added to a half-wave dipole antenna, and the first conductive member 131 and second conductive member 132 may be electrically symmetrical. It is similar to a second embodiment which will be described later.

Figure 4C:
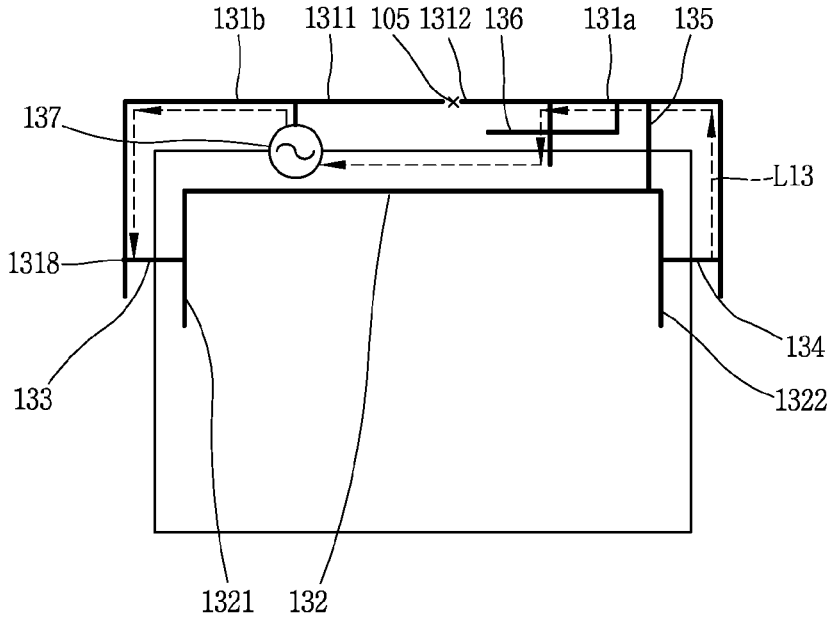

In case of such a folded dipole antenna, little current may flow through a portion 1318 at which the first conductive member 131 is connected to the second conductive member 132 at a specific resonant frequency. In other words, a current flowing through the first conductive member 131 and a current flowing through the second conductive member 132 may flow in opposite directions, and there may exist a current null point at which little current flows through a connecting position 1318 between the first conductive member 131 and second conductive member 132. In this case, it may be understood that a resonant path is formed only on the first conductive member 131. In other words, as illustrated in FIG. 4C, a third resonant path (L13) may be formed on the first conductive member 131, but formed as a path for connecting the feeding portion 137 to the grounding portion 138 in the vicinity of the slit 105 of the first conductive member 131.

Figure 4D:
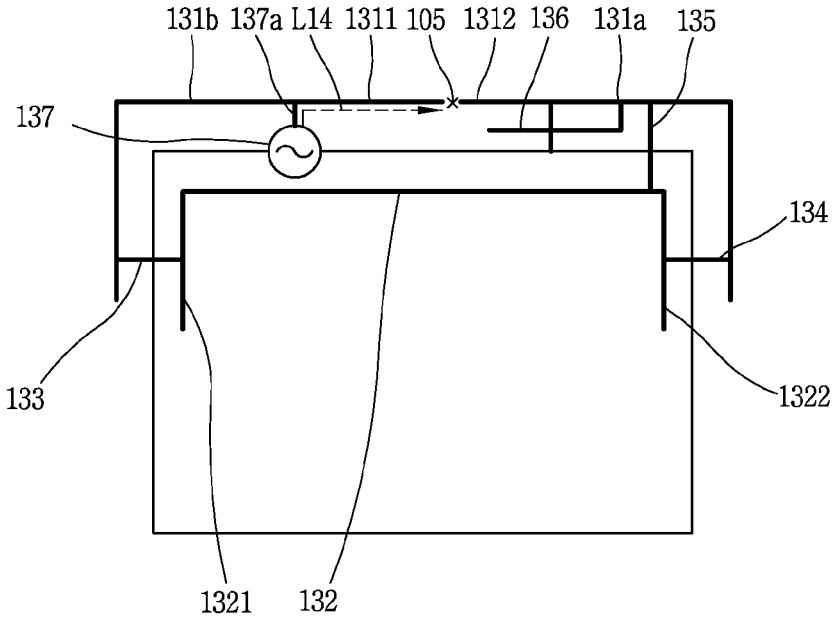

Furthermore, according to a first embodiment of the present disclosure, the slit 105 may be formed on the first conductive member 131, and as illustrated in FIG. 4D, a fourth resonant path (L14) may be formed by a feeding line 137*a* connecting the feeding portion 137 to the first conductive member 131 and a path formed with an open end 1311 of the second portion 131*b* forming the slit 105 to implement a fourth resonant frequency (F14).

Figure 4E:
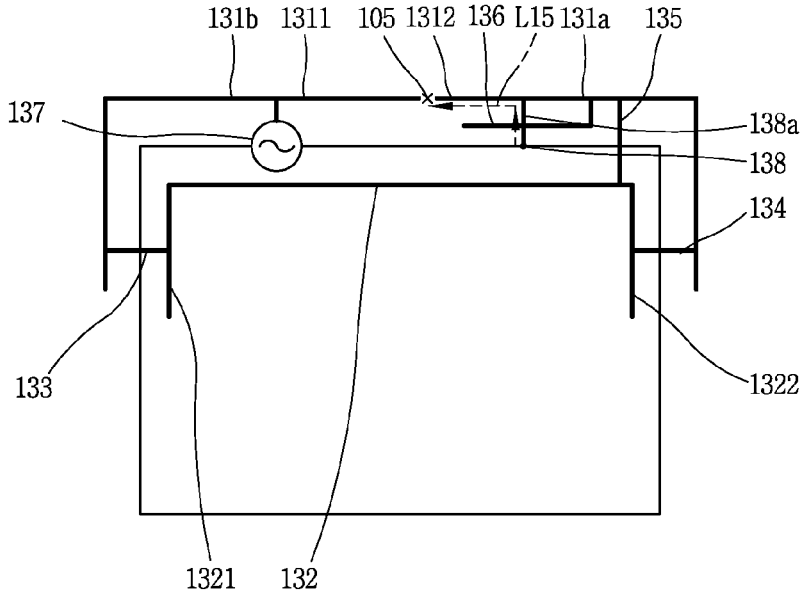
Figure 4F:
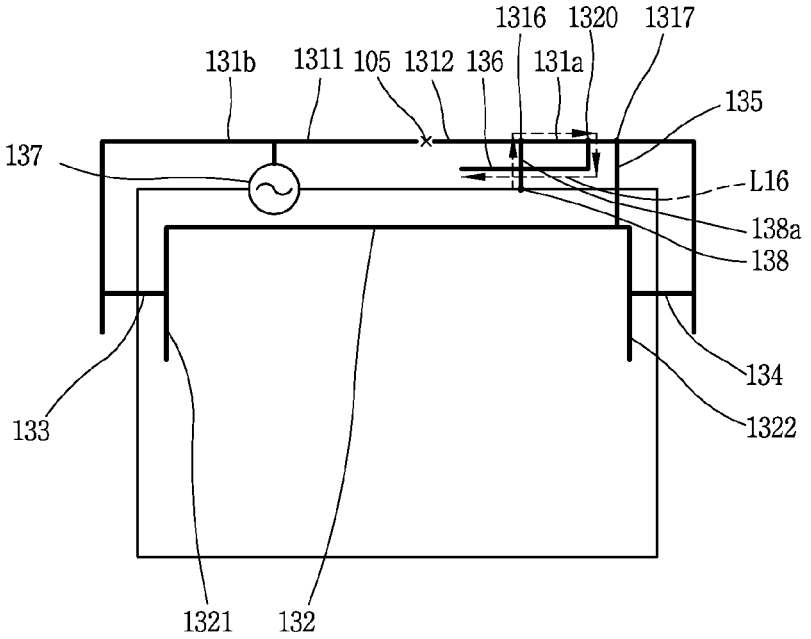

Moreover, as illustrated in FIG. 4E, a fifth resonant frequency (F15) may be implemented by a grounding line 138*a* connecting the grounding portion 138 to the first conductive member 131 and an open end 1312 of the first portion 131*a* forming the slit 105. The grounding line 138*a* according to an embodiment of the present disclosure may include at least one of a grounding plate, a clip for grounding and a grounding line as an electrical path connecting the grounding portion 138 and the first conductive member 131. It is the same for all grounding portions in the first and the second embodiment of the present disclosure.

In addition, according to an embodiment of the present disclosure, the sub-arm 136 may be formed on the first conductive member 131 to implement a higher resonant frequency. In other words, one end portion may be connected to the first conductive member 131, and the other end portion may include an open sub-arm 136. Here, the formation position 1320 of one end portion of the sub-arm 136 is formed between a portion 1316 connected to the grounding portion 138 through the grounding line 138*a* and a portion 1317 connected to the third connecting member 135 on the first conductive member 131. A sixth resonant path (L16) formed from the grounding line 138*a* to an open end of the sub-arm 136 passing through the first conductive member 131 may be formed to implement a sixth resonant frequency (F16).

Figure 11:
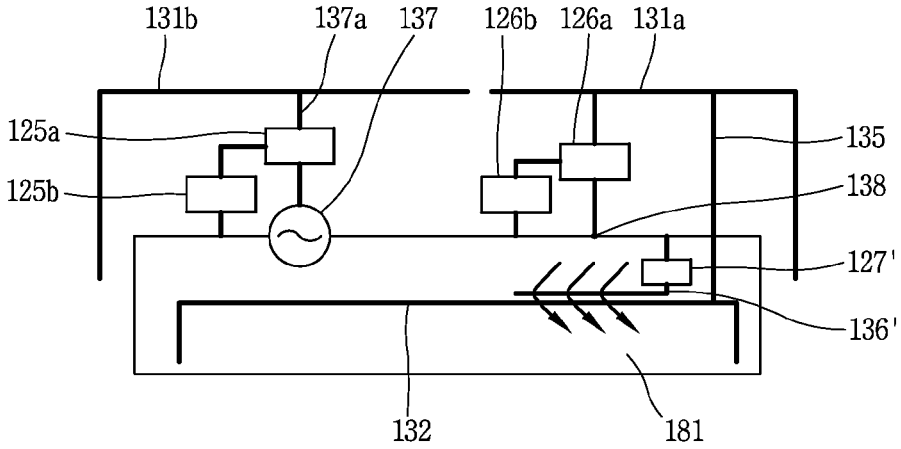
FIG. 11 is a conceptual view illustrating another modified example of an antenna module according to a first embodiment of the present disclosure.
Figure 12A:
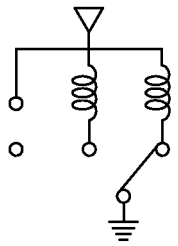
FIGS. 12A, 12B, 12C, 12D, 12E and 12F are views illustrating the type of variable switches according to an embodiment of the present disclosure.
Figure 12B:
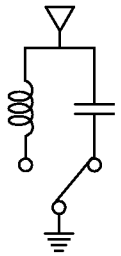
Figure 12C:
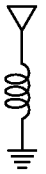
Figure 12D:
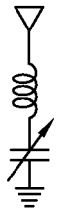
Figure 12E:
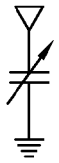
Figure 12F:
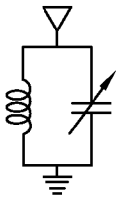

Furthermore, as illustrated in FIG. 11, one end portion of the sub-arm 127' may be ground-connected to the circuit board 181, and the other end portion thereof may be open. It will be described later.

In this manner, according to an embodiment of the present disclosure, the slit 105 may be formed on the first conductive member 131 to facilitate the implementation of a high frequency band as well as a low frequency band.

However, the position 1320 of one end portion of the sub-arm 136 may not be necessarily limited to this. For example, one end portion of the sub-arm 136 may vary between a portion 1317 connected to the third connecting member 135 and a portion 1319 connected to the second conductive member 132 on the first conductive member 131. However, when the position of the sub-arm 136 is changed, a resonant path may be changed to change the resonant frequency.

Here, the fourth through the sixth resonant frequency (F14, F15, F16) is operated as a monopole antenna an end of which is open, and the antenna length may have a length of about $\lambda/4$ corresponding to a resonant frequency.

Hereinafter, a method of tuning to implement the foregoing resonant frequencies in a more broadband manner will be described.

Figure 10:
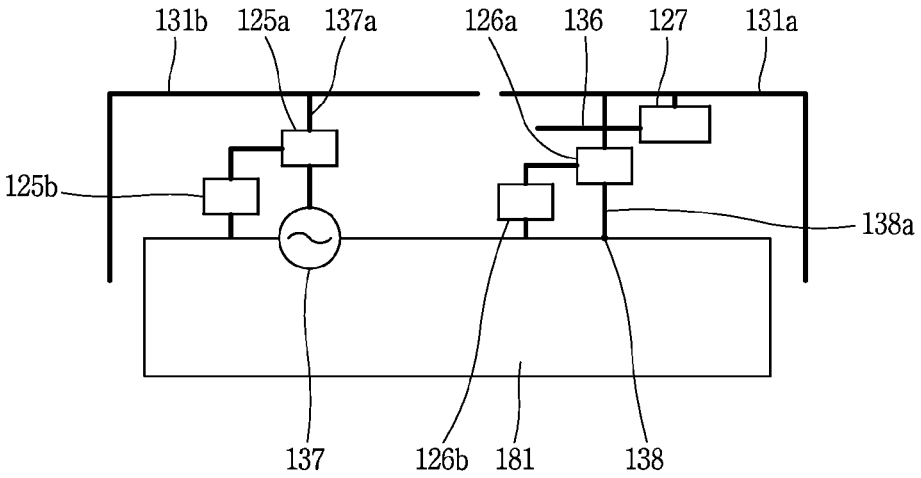
FIG. 10 is a conceptual view illustrating part of an antenna module according to a first embodiment of the present disclosure.

FIG. 10 is a conceptual view illustrating part of an antenna module 130 according to a first embodiment of the present disclosure, and will be described below with reference to FIG. 10.

Referring to FIG. 10, a first matching module 125*a* for impedance matching is disposed on the feeding line 137*a* connected to the feeding portion 137 to feed the first conductive member 131, and a first variable switch 125*b* for controlling a current flowing through the first portion 131*a* is connected to the first matching module 125*a*. Here, the first variable switch 125*b* may be connected to the first matching module 125*a* in series or in parallel.

Furthermore, a second matching module 126*a* for impedance matching is disposed on the grounding line 138*a* connected to the grounding portion 138 to ground the first conductive member 131, and a second variable switch 126*b* for controlling a current flowing through the first portion 131*a* is connected to the second matching module 126*a* in series or in parallel. In addition, a third variable switch 136 for controlling a current flowing through the sub-arm 136 may be formed on the sub-arm 136.

Though not shown in detail in the drawing, a variable switch may be formed on the third connecting member 135. However, here, a desired resonant frequency may be implemented by changing the formation position of the third connecting member 135, and there is a case where the variable switch may not be formed.

The foregoing first matching module 125*a* and second matching module 126*a* may be formed with a combination of an inductor and a capacitor, and implemented with series or shunt elements. When formed with series elements, a reactance value which is an imaginary part of impedance may be changed. For an example, an inductor increases the reactance and a capacitor decreases the reactance, and thus the impedance at a specific frequency band may be changed. On the contrary, when formed with shunt elements, a resistance value which is a real part of impedance may be changed. For example, the inductor increases the resistance value and the capacitor decreases the resistance value to change the impedance at a specific frequency band.

Figure 6:
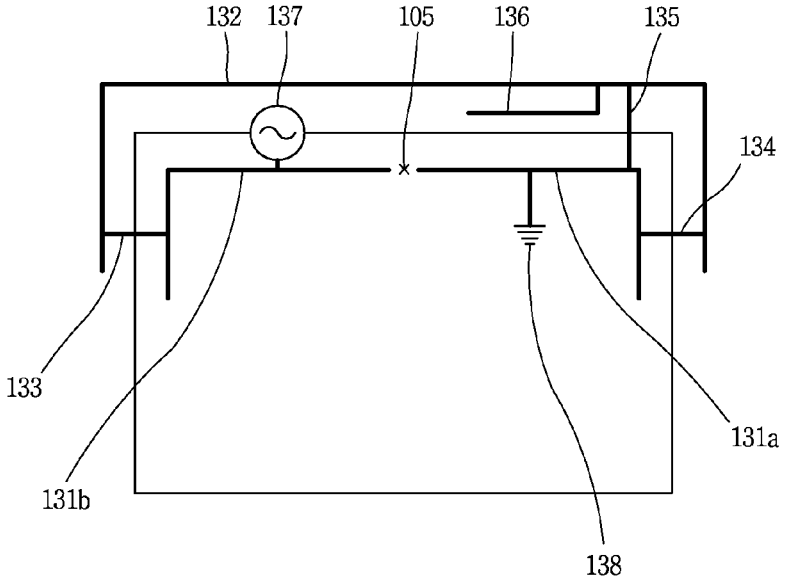
FIG. 6 is a conceptual view illustrating a modified example of an antenna module according to a first embodiment of the present disclosure.

The foregoing first embodiment has described a case where the first conductive member 131 forms a lateral surface of the terminal body of the mobile terminal, and the second conductive member 132 is provided in the terminal body. FIG. 6 is a conceptual view illustrating a modified example of an antenna module 130 according to a first embodiment of the present disclosure, and illustrates a case where the positions of the first conductive member 131 and second conductive member 132 are changed with each other, contrary to the foregoing case.

In other words, it illustrates a case where the first conductive member 131 is formed within the terminal body, and the second conductive member 132 forms a lateral surface of the terminal body.

If the second conductive member 132 is formed on a lateral appearance of the terminal body, and the first conductive member 131 is disposed within the terminal body, the lateral surface of the mobile terminal may be streamlined for a sleek look to provide an elegant appearance. An exploded perspective view of a mobile terminal associated therewith is illustrated in FIG. 2C. Here, the slit 105 should be spaced apart to the extent that coupling does not occur.

Furthermore, as illustrated in FIG. 2A, when the first conductive member 131 forms a lateral appearance of the mobile terminal, a portion formed with the slit 105 may be a problem, but an interface unit 119 such as a USB port may be formed at the portion formed with the slit 105, and thus the appearance is not greatly affected. In other words, an adjoining portion of the interface unit 119 is separated from the first portion 131*a* and second portion 131*b*, and thus a current does not flow.

However, as illustrated in FIGS. 6 and 2C, the slit is formed within the mobile terminal 100 and thus not exposed to the outside.

FIG. 6 illustrates only a portion shown in FIG. 4A to be easily compared with FIG. 4A, and the matching modules 125*a*, 126*a* and variable switches 125*b*, 126*b*, 27) are not shown as illustrated in FIGS. 10 and 11, but the addition of those configurations may not be limited in particular. In other words, though the modified example illustrated in FIG. 6 is not shown in detail, the items illustrated in FIGS. 10 and 11 may be applicable as it is. For example, a first matching module may be disposed at a portion connected to the feeding portion 137 and second portion 131*b* in FIG. 6, and a second matching module may be disposed at a portion connected to the grounding portion 138 and first portion 131*a* in FIG. 6, and a first and a second variable switch may be provided in the first and the second matching module, respectively. Moreover, a third variable switch may be also provided in the sub-arm 136 illustrated in FIG. 6.

FIG. 11 is a conceptual view illustrating another modified example of an antenna module 130 according to a first embodiment of the present disclosure, and illustrates that the sub-arm 136' is ground-connected to the circuit board 181 which is the ground, and the variable switch 127' is formed on the sub-arm 136'. In this manner, the sub-arm 136' and second conductive member 132 are formed to be separated from each other to generate electromagnetic coupling, thereby adding a resonant frequency band. Here, at least part of the sub-arm 136' may be formed in parallel to the second conductive member 132 to further generate electromagnetic coupling.

FIG. 12 is a view illustrating the type of variable switches according to an embodiment of the present disclosure, in which they are formed with various combinations of a capacitor and an inductor. For example, as illustrated in FIG. 12B, the variable switch may have inductors with different sizes as illustrated in FIG. 12A, or have an inductor and a capacitor as illustrated in FIG. 12B, or have only one inductor as illustrated in FIG. 12C. Furthermore, an inductor and a variable capacitor are connected in series as illustrated in FIG. 12D, and have a variable capacitor as illustrated in FIG. 12E, and an inductor and a variable capacitor are connected in parallel as illustrated in FIG. 12F.

The foregoing examples illustrate only one example, and a variable inductor may be used, and a single pole double throw (SPDT) switch and a single pole triple throw (SP3T) switch may be also used.

Such a variable switch will be apparent to those skilled in the art, and thus the detailed description thereof will be omitted.

Figure 5:
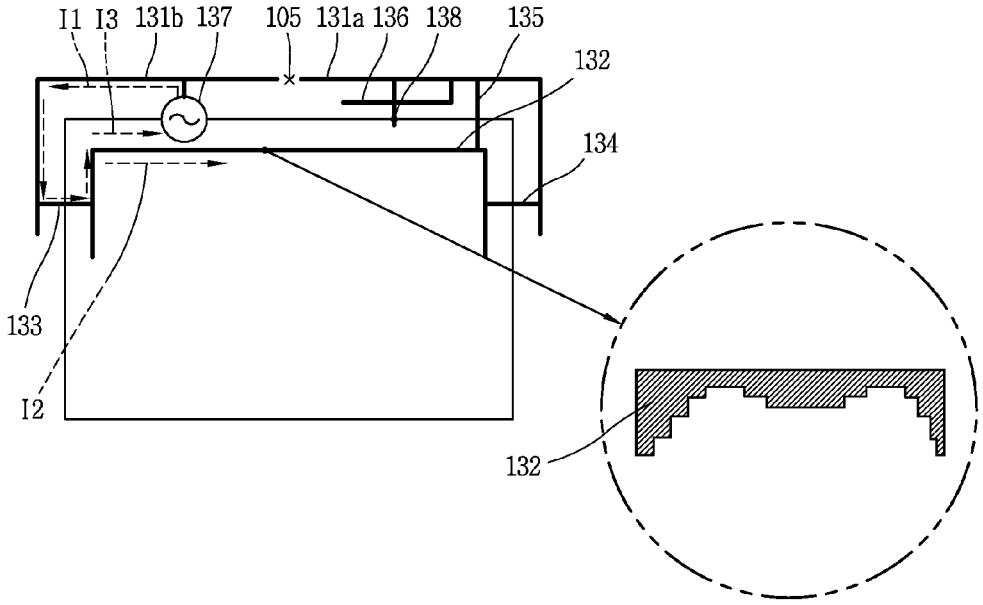
FIG. 5 is a conceptual view and a partially enlarged view illustrating an antenna module according to a first embodiment of the present invention.

FIG. 5 is a conceptual view and a partially enlarged view illustrating an antenna module 130 according to a first embodiment of the present invention, in which the first conductive member 131 in a first embodiment of the present disclosure may form a lateral appearance of the mobile terminal, and the second conductive member 132 may be disposed within the terminal body.

Figure 7:
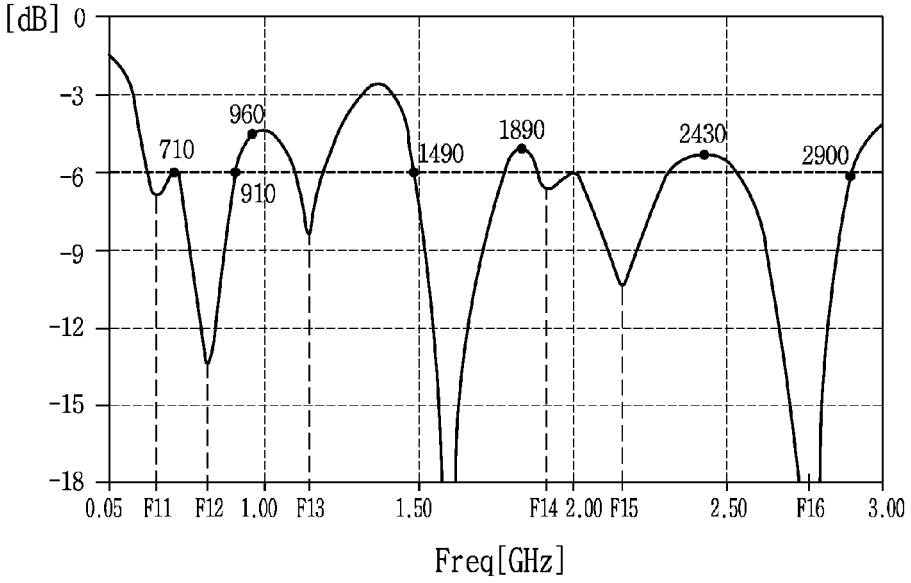
FIG. 7 is a graph illustrating a reflection coefficient according to a frequency of an antenna module according to a first embodiment of the present disclosure.

FIG. 7 is a graph illustrating a reflection coefficient according to a frequency of an antenna module 130 according to a first embodiment of the present disclosure, and it is seen that the antenna module resonates at a first through a third resonant frequency (F11, F12, F13) in the vicinity of 700 MHz, 800 MHz and 1200 MHz, and resonates at a fourth through a sixth resonant frequency (F14, F15, F16) in the vicinity of 1900 MHz, 2200 MHz and 2700 MHz. The result illustrates only one embodiment, and the present disclosure may not be necessarily limited to those resonant frequencies in interpreting the right scope of the present disclosure.

Figure 8:
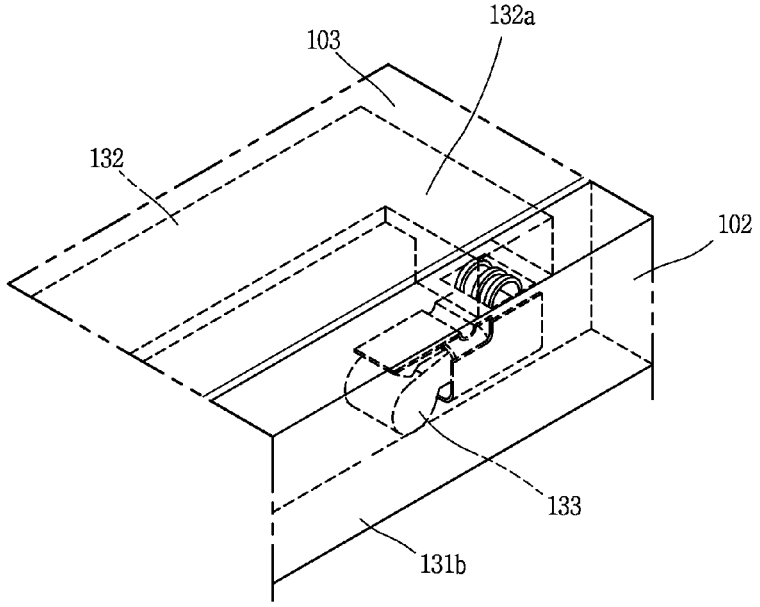
FIG. 8 is an enlarged view illustrating portion "A" shown in FIG. 1C.
Figure 9A:
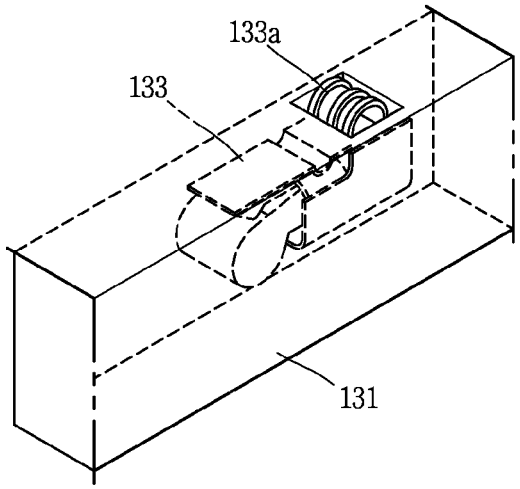
FIG. 9A is a conceptual view illustrating in which only a first conductive member is separated from FIG. 8, and FIGS. 9B and 9C are conceptual views in which only a rear cover is separated from FIG. 8.
Figure 9B:
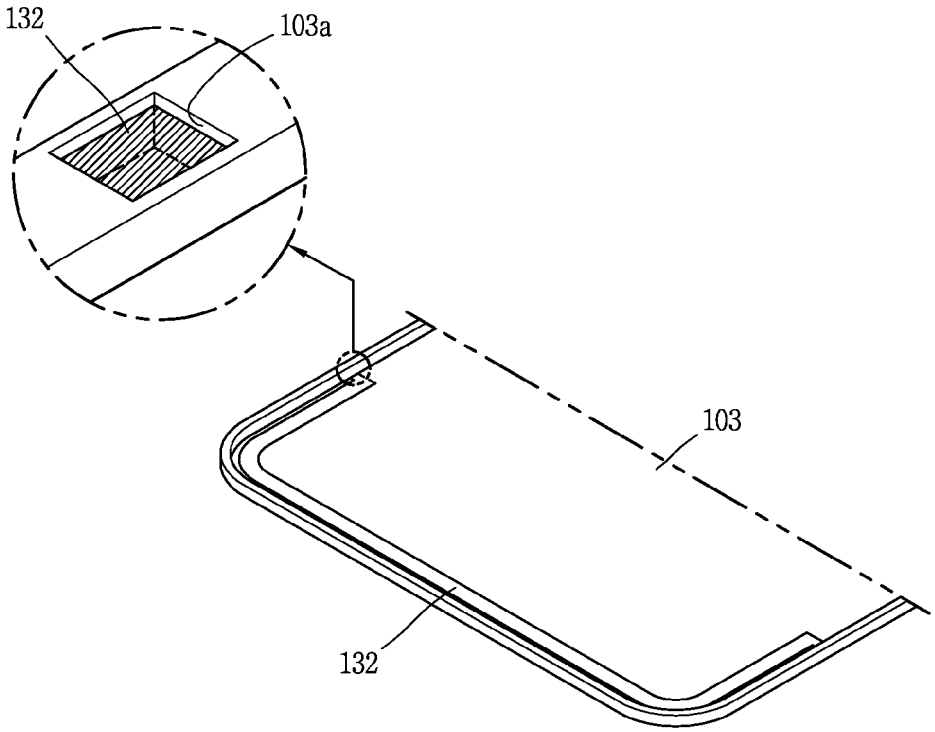
Figure 9C:
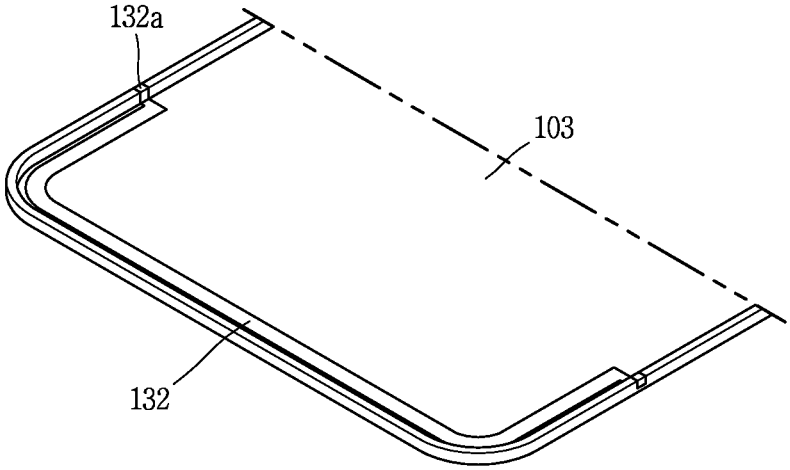

On the other hand, FIG. 8 is an enlarged view illustrating portion "A" shown in FIG. 1C, and FIG. 9A is a conceptual view illustrating in which only a first conductive member 131 is separated from FIG. 8, and FIGS. 9B and 9C are conceptual views in which only a rear cover 103 is separated from FIG. 8.

Referring to the above drawings, when the rear cover 103 is coupled to the rear case 102, the first conductive member 131 is electrically connected to the second conductive member 132 through the first connecting member 133. A structure which will be described below may be similarly applicable to an electrical connecting structure between the first conductive member 131 and the second conductive member 132 through the second connecting member 134.

The first connecting member 133 is mounted either one of the rear cover 103 and first conductive member 131, and allowed to electrically connect the first conductive member 131 to the second conductive member 132 through a contact with the other one. The second conductive member 132 and the first conductive member 131 may be electrically connected to each other due to the contact, and the contact may be securely maintained due to elastic deformation. For the foregoing elastic deformation, according to an embodiment of the present disclosure, a C-clip, a pogo pin or EMI sheet may be used for the first and the second connecting member 131, 132.

The first connecting member 133 may be mounted at an inner side of the rear cover 103 or mounted on the rear case 102 as illustrated in FIG. 2D. FIGS. 8, 9A through 9C illustrate that the second conductive member 132 is provided in the rear cover 103, and it may be configured such that the first connecting member 133 is mounted on the first conductive member 131 to be protruded from the first conductive member 131. For an example, as illustrated in FIG. 9A, the first connecting member 133 may be accommodated into the first conductive member 131 in such a manner that at least part 133*a* thereof is disposed to be protruded from the first conductive member 131. For another example, the first connecting member 133 may be coupled to an inner surface of the first conductive member 131 in such a manner that at least part thereof is disposed to be protruded from the first conductive member 131 or to cover an upper surface of the first conductive member 131.

Furthermore, as illustrated in FIG. 9B, it may be configured such that the first connecting member 133 protruded from either one of the rear cover 103 and first conductive member 131 to be inserted into the groove 103*a* formed on the other one. For example, FIG. 9B is a perspective view in which an inner portion of the rear cover 103 is seen, and as illustrated in FIG. 9B, a groove 103*a* corresponding to the first connecting member 133 may be formed on the rear cover 103. Here, when the rear cover 103 is coupled to the rear case 102, the groove 103*a* is configured to accommodate the first connecting member 133.

Part of the second conductive member 132 may be exposed to the outside through the groove 103*a*. In other words, the second conductive member 132 forms a bottom portion of the groove 103*a*.

On the other hand, as illustrated in FIG. 9C, the second conductive member 132 may be formed to traverse the rear cover 103. In this case, the first connecting member 133 may be electrically connected to the second conductive member 132 even when the first connecting member 133 formed on the rear case 102 is slightly exposed to the outside.

In other words, according to an embodiment of the present disclosure, a method of connecting the first and the second conductive member 131, 132 may not be limited.

As illustrated in FIG. 8, when the rear cover 103 is coupled to the rear case 102, at least part 133*a* of the first connecting member 133 is inserted into the groove 103*a*, and brought into contact with the second conductive member 132 exposed through the groove 103*a*. Here, an extension portion 132*a* is formed on the second conductive member 132 to be brought into contact with an exposed portion 133*a* of the first connecting member 133. It is similar to the other end of the second conductive member 132.

When the first and the second conductive member 131, 132, 231, 232 are connected to each other, the extension portion 132*a* is formed as described above for more efficient contact.

Due to the structure, the first connecting member 133 may not only electrically connect the first conductive member 131 to the second conductive member 132 but also be inserted into the groove 103*a* such that that rear cover 103 is securely fixed to the rear case 102. Here, the first conductive member 131 may be coupled to the second conductive member 132 using a screw (not shown) to further secure the first conductive member 131 and second conductive member 132.

The foregoing description has described only an example of an electrical connecting structure between the first conductive member 131 and second conductive member 132 using the first connecting member 133, but the present disclosure may not be necessarily limited to this.

Figure 13:
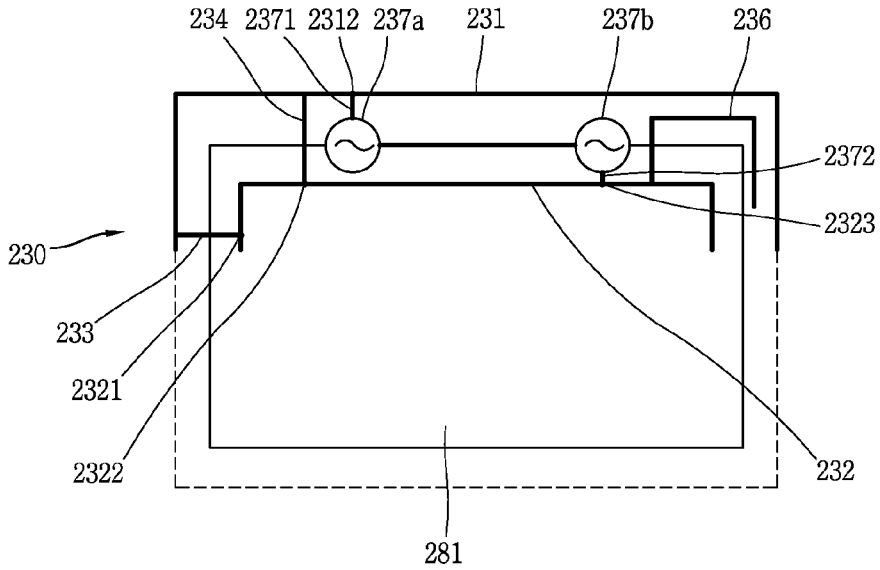
FIG. 13 is a conceptual view illustrating an antenna module according to a second embodiment of the present disclosure.

FIG. 13 is a conceptual view illustrating an antenna module 230 according to a second embodiment of the present disclosure, and will be described below with reference to FIG. 13.

Though not shown in detail in the drawing, even in a second embodiment of the present disclosure, the first conductive member 231 may form a lateral appearance of the terminal body, and the second conductive member 232 may be formed within the terminal body. It is similar to the drawings of FIGS. 2A through 2D, and thus the description thereof will be substituted by the earlier description of FIGS. 2A through 2D.

According to a second embodiment of the present disclosure, block members 211, 212 are added to independently implement a high and a low band resonant frequency by two feeding portions 237*a*, 237*b*. Hereinafter, it will be described in more detail.

An antenna module 230 according to a second embodiment may include a first conductive member 231 fed by a first feeding portion 237*a*, a second conductive member 232 disposed to be separated from the first conductive member 231, and fed by a second feeding portion 237*b*, a first connecting member 233 connected to one side of the first conductive member 231 and second conductive member 232, and a second connecting member 234 connected to one middle position between the first conductive member 231 and second conductive member 232.

Here, the first connecting member 233 is formed at a position adjacent to the first feeding portion 237*a*, and one end portion thereof is connected to the first conductive member 231, and the other end portion thereof is connected to the second conductive member 232, and a position of the one end portion varies between a portion 2312 connected to the first feeding portion 237*a* and an end of the first conductive member 231 on the first conductive member 231, and a position of the other end portion varies between a portion 2323 connected to the second feeding portion 237*b* and an end of the second conductive member 232 on the second conductive member 232. However, preferably, the second connecting member 234 varies between a position at which the second connecting member 234 is connected to the second conductive member 232 and an end of the second conductive member 232.

Even here, as in the foregoing first embodiment, the first and the second connecting member 233, 234 may vary a resonant frequency band according to the variation of the position, and though reference numerals are not designated herein, a parasitic arm may be formed at a portion in which the first connecting member 233 is connected to the first and the second conductive member 231, 232. In other words, the first connecting member 233 may be connected to an end of the first and the second conductive member 231, 232, and may be connected to one middle position thereof, and a parasitic arm may be formed when the first connecting member 233 is connected to a middle position between the first and the second conductive member 231, 232. Even in the second embodiment, the resonant frequency may be minutely tuned by the parasitic arm as in the first embodiment.

Furthermore, even in case of the second connecting member 234, similarly to the first connecting member 233, one end portion thereof is connected to the first conductive member 231, and the other end portion thereof is connected to the second conductive member 232. Here, the one end portion thereof varies between a portion 2312 connected to the first feeding portion 237*a* through a first feeding line 2371 and a portion 2311 connected to the first connecting member 233 through the first conductive member 231 on the first conductive member 231, and the other portion thereof varies between a portion 2323 at which the second feeding portion 237*b* is connected to the second conductive member 232 through a second feeding line 2372 and a portion 2321 at which the first connecting member 233 is connected to the second conductive member 232 on the second conductive member 232.

Here, the first conductive member 231 and second conductive member 232 are open at a position adjacent to the 237*b*.

According to the foregoing configuration, the first feeding portion 237*a* and second feeding portion 237*b* may implement resonant frequencies at different band frequencies without interfering with each other. In other words, the first feeding portion 237*a* may feed the first conductive member 231 to implement a resonant frequency at a lower frequency band, and the second feeding portion 237*b* may feed the second conductive member 232 to implement a resonant frequency at a higher frequency band. Here, contrary to the foregoing first embodiment, an end portion of the first conductive member 231 and second conductive member 232 is open. Here, an open end of the first conductive member 231 may form a lateral appearance of the terminal body. In other words, an open end of the first conductive member 231 may be formed into an integral body with a lateral surface of the terminal body.

Figure 14:
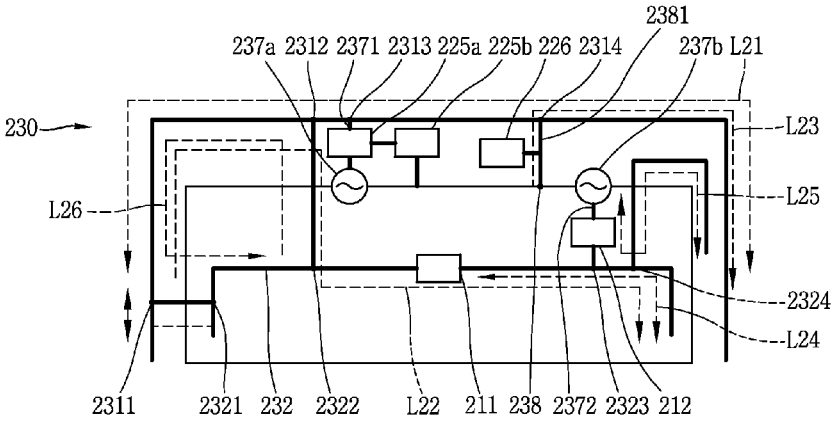
FIG. 14 is a view illustrating a resonant path according to a second embodiment of the present disclosure.

In addition, FIG. 14 illustrates a resonant path according to a second embodiment of the present disclosure, in which a first resonant path (L21) is formed by the first conductive member 231 to implement a first resonant frequency (F21). Here, similarly to the foregoing first embodiment, the first conductive member 231 and second conductive member 232 form a folded dipole antenna, and thus an input resistance of the folded dipole antenna is larger than that of a half-wave dipole antenna by about four times, and thus the radiation power and radiation resistance thereof increase four times compared to those of a half-wave dipole antenna. Accordingly, matching to a feeding line having a large characteristic impedance may be facilitated, thereby implementing broadband characteristics.

Furthermore, the first conductive member 231, second conductive member 232 and second connecting member 234 may implement a second resonant path (L22) to implement a second resonant frequency (F22).

Furthermore, as illustrated in FIG. 14, the first conductive member 231 is earthed to the ground through a grounding line 2381, and a second variable switch 226 is formed on the grounding line 2381, thereby forming a third resonant path (L23). In other words, a third resonant frequency (F23) may be implemented by the third resonant path (L23) that is formed as an open end of the first conductive member 231 starting from the grounding line 2381 and then passing through a portion 2314 at which the grounding line 2381 is connected to the first conductive member 231.

According to a second embodiment of the present disclosure, it is allowed to resonate even at a frequency band other than the first through the third resonant frequency (F21, F22, F23), and a configuration in which a resonant frequency implemented by the first feeding portion 237*a* and a resonant frequency implemented by the second feeding portion 237*b* do not electromagnetically affect each other is added. In other words, since the conductive members 231, 232 are formed within a smaller space, the frequency band can be extended using interference between the conductive members 231, 232.

For example, as illustrated in FIG. 14, a first block member 211 formed between a portion 2322 connected to the second connecting member 234 and a portion 2323 connected to the second feeding portion 237*b* through the second feeding line 2372 on the second conductive member 232 to block a current generated from the second feeding portion 237*b* from flowing to the first feeding portion 237*a* is added, and a second block member 212 formed on the second feeding line 237*b* connected to the second feeding portion 237*b* to feed the second conductive member 232 to block a current generated from the first feeding portion 237*a* from flowing to the second feeding portion 237*b* is further added. The frequency band can be independently implemented by the first block member 211 and second block member 212.

In this manner, a current may be blocked by the first block member 211 and second block member 212, thereby allowing a current due to the second feeding portion 237*b* to implement a fifth resonant frequency (F24) by a fourth resonant path (L24) formed up to an end of the first block member 211 and second conductive member 232.

Furthermore, in order to implement a higher resonant frequency, the second embodiment of the present disclosure forms the sub-arm 236, in which the sub-arm 236 is formed on the second conductive member 232, and one end portion thereof is formed between a portion 2323 connected to the second feeding portion 237*b* and an open end adjacent to the second feeding portion 237*b* among the open ends of the second conductive member 232, and the other end portion thereof is open.

In this manner, a fifth resonant frequency (L25) is formed due to the sub-arm 236 fed by the second feeding portion 237*b*. The fifth resonant frequency (L25) is formed on the second feeding line 2372 connected to the second conductive member 232 from the second feeding portion 237*b*, the second conductive member 232, and the sub-arm 236, thereby implementing a fifth resonant frequency (L25). Here, the position of the sub-arm 236 may not be necessarily limited to the position. For example, one end portion of the sub-arm 236 may vary between a portion 2323 connected to the second feeding portion 237*b* and the first block member 211 on the second conductive member 232.

However, when the position of the sub-arm 236 is changed, a resonant path may be changed to change the resonant frequency.

Furthermore, a sixth resonant path (L26) may be formed by the first connecting member 233, second connecting member 234, first conductive member 231 and second conductive member 232, thereby implementing a sixth resonant frequency.

Figure 15:
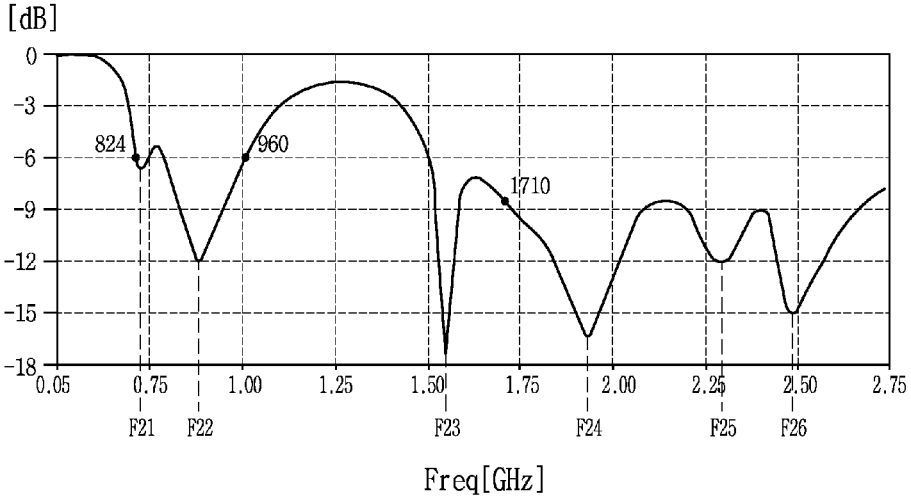
FIG. 15 is a graph illustrating a reflection coefficient according to a frequency of an antenna module according to a second embodiment of the present disclosure.

FIG. 15 is a graph illustrating a reflection coefficient according to a frequency associated with a second embodiment of the present disclosure, and it is seen that the antenna module resonates at 700 MHz, 800 MHz, 1600 MHz, 1900 MHz, 2300 MHz and 2450 MHz. The result illustrates only one embodiment, and the present disclosure may not be necessarily limited to those resonant frequencies in interpreting the right scope of the present disclosure.

According to a second embodiment of the present disclosure, matching modules may be disposed to tune each resonant frequency. For example, a first matching module 225*a* may be formed on the first feeding line 2371 for feeding the first conductive member 231, and for the first matching module 225*a*, a first variable switch 225*b* for controlling a current flowing through the first conductive member 231 may be connected to the first matching module 225*a* in series or in parallel. Here, the first variable switch 225*b* and second variable switch 226 may be formed with a combination of an inductor and a capacitor as illustrated in the foregoing drawing of FIG. 12.

Furthermore, a block member for blocking the flow of a current may include one or more lumped element. For the lumped element, an inductor or capacitor may be used, and a conductive pattern may be formed on a substrate to operate as a capacitor and an inductor, respectively.

The block member may block an antenna module from resonating at a specific frequency band. Furthermore, even when the antenna module resonates in actuality, the block member may block a signal due to resonance from being introduced to and radiated from the mobile terminal. For example, when the block frequency band of the block member is F1 or F2, the antenna module may be formed to block signals within F1 or F2 band.

The block member 211, 212 is basically seen as a type of filter to block frequencies in a specific band, and the block member 211, 212 may be formed with a combination of an inductor and a capacitor in series or in parallel.

When the block member includes one or more inductors, it may block signals corresponding to frequencies higher than F1 in the block frequency band (F1 or F2), and when the block member includes one or more capacitors, it may block signals corresponding to frequencies lower than F1 in the block frequency band (F1 or F2). Furthermore, when the block member is combined with an inductor and a capacitor, it may block the antenna module 230 from resonating at a specific frequency band.

Furthermore, the block member may include a capacitor, an inductor and a switching element, wherein the switching element may selectively switches the capacitor and inductor or connect the capacitor and inductor at the same time. Moreover, specific frequencies may be blocked with a combination including the inductor and/or capacitor, wherein the capacitor is a variable capacitor.

In other words, the first block member 211 according to a second embodiment of the present disclosure may be a type of low pass filter formed to include an inductor that passes only resonant frequencies lower than a specific frequency without passing resonant frequencies higher than the specific frequency, and the second block member 212 may be a type of high pass filter formed to include a capacitor that passes only resonant frequencies higher than a specific frequency without passing resonant frequencies lower than the specific frequency.

However, the first and the second block member 211, 212 according to an embodiment of the present disclosure are only required to block resonant frequencies at a specific frequency band, respectively, and may be a band pass filter for passing resonant frequencies having a predetermined bandwidth or a notch filter for blocking resonant frequencies at a specific band.

According to a second embodiment of the present disclosure, the second block member 232 including a capacitor is formed on the second feeding line 2372, and the second block member 231 including an inductor is formed on the second conductive member 232, but it is disposed in a such a manner that resonant frequencies in a high frequency band are mainly implemented by the second feeding portion 237*b* and resonant frequencies in a low frequency band are mainly implemented by the first feeding portion 237*a*. Accordingly, when the first feeding portion 237*a* implements resonant frequencies in a high frequency band, the first block member 211 may include a capacitor to block frequencies in a low frequency band, and the second block member 212 may include an inductor to block frequencies in a high frequency band.

On the other hand, at least part of the sub-arm 236 may be formed adjacent to the first conductive member 231 to be separated therefrom so as to generate electric coupling with the first conductive member 231. Here, the first conductive member 231 and sub-arm 236 may be formed adjacent to each other in parallel.

In other words, according to a second embodiment of the present disclosure, electrical coupling is generated between a current formed at an open end of the first conductive member 231 adjacent to the second feeding portion 237*b* to extend the frequency band and a current formed on the sub-arm 236 to form a third resonant path (L23). In this manner, the flows of each current implementing a high frequency band and a low frequency band, respectively, exert an effect on each other to form an additional resonant path (L23), thereby having an advantage in the aspect of space use. In other words, it may be possible to implement resonant frequencies having high frequencies, low frequencies and a medium frequencies therebetween within a limited space. As a result, a high frequency band can be optimally designed.

Furthermore, according to an embodiment of the present disclosure, there is disclosed a mobile terminal having an antenna module 130, 230 in the foregoing first embodiment and second embodiment. A mobile terminal having the antenna module 130 according to the first embodiment is referred to as a third embodiment, and a mobile terminal having the antenna module 230 according to the second embodiment is referred to as a fourth embodiment.

First, a mobile terminal according to a third embodiment will be described.

The antenna module 130 according to a third embodiment is formed on a body of the mobile terminal, and formed to operate at a first frequency and a second frequency. Here, the first frequency may be frequencies in a low frequency band and the second frequency be frequencies in a high frequency band.

To this end, the antenna module 130 may include the first and the second connecting member 133,134 connecting both ends of the first conductive member 131 and second conductive member 132 and the first conductive member 131 and second conductive member 132, respectively, and the first conductive member 231 is connected to the feeding portion 137 and grounding portion 138, and the slit 105 is formed on the first conductive member 131, wherein the slit 105 is formed between the feeding portion 137 and grounding portion 138.

Here, the first conductive member 131 and second conductive member second conductive member 132 form a lateral appearance of the terminal body or is formed within the terminal body. For example, when the first conductive member 131 forms a lateral appearance of the terminal body, the second conductive member 132 is disposed within the terminal body, and when the second conductive member 132 is disposed within the terminal body, the second conductive member 132 may form a lateral appearance of the terminal body.

Furthermore, when the first conductive member 131 or second conductive member 132 forms a lateral appearance of the terminal body, the first conductive member 131 or second conductive member 132 may form part or all of a lateral surface of the terminal body. If the first conductive member 131 or second conductive member 132 forms part of a lateral surface of the terminal body, an insulating material 102*a* may be formed to be separated from the remaining portion 102*b* of the lateral surface of the terminal body by a predetermined distance. Furthermore, when the remaining portion 102*b* of the lateral surface of the terminal body is made of a metal, the remaining portion 102*b* may be preferably earthed to the ground not to affect on the antenna module 130.

On the other hand, when the first conductive member 131 or second conductive member 132 forms the entire lateral appearance of the terminal body, for example, when the first conductive member 131 forms a lateral appearance of the terminal body and the second conductive member 132 is disposed within the terminal body as illustrated in FIG. 2A, the first conductive member 131 and the remaining portion 102*b* (refer to FIG. 2B) may be separated by the first connecting member 133 and second connecting member 134, and thus an additional grounding line may not be required, and they seem to be formed into an integral body when seen from the outside. Accordingly, an end portion of the first conductive member 131 is shown as a dotted line in FIGS. 2A, 2C and 2D.

In other words, according to a first and a second embodiment of the present disclosure, the first conductive member 131, 231 or second conductive member 132, 232 may form a lateral appearance of the terminal body, and when forming a lateral appearance of the terminal body, an additional slit is not required if the material of the remaining portion 102*b* is a material different from the first conductive member 131, 231 and second conductive member 132,232, in particular, a polycarbonate material. If it is a metal material similar to the first conductive member 131, 231 and second conductive member 132, 232, a slit may be formed between the first or the second conductive member 131, 132, 231, 232 and the remaining portion 102*b* or should be grounded at one side of the first or the second conductive member 131, 132, 231, 232 as in the foregoing first embodiment and second embodiment.

The first conductive member 131 and second conductive member 132 may be made on planes, and the planes, respectively, may be formed to be perpendicular to each other. In other words, as illustrated in FIGS. 2A through 2D, the first conductive member 131 and second conductive member 132 may be formed on planes, and made perpendicular to each other. However, the present disclosure may not be necessarily limited to this. For example, the first conductive member 131 and second conductive member 132 may be disposed within the terminal body without forming a lateral appearance of the terminal body, and they may not be formed to be perpendicular to each other on at least part thereof. Moreover, two planes of the first and the second conductive member 131, 132, 231, 232 may be formed in parallel to each other.

Furthermore, when the first conductive member 131 forms a lateral appearance of the terminal, it is formed along the shape of the mobile terminal, and thus at least part of the edge portion thereof may be formed with a curved surface.

Here, as illustrated in FIG. 5, the second conductive member 132 may be formed in a non-uniform pattern, and it is to efficiently carry out impedance matching. For an example, the second conductive member 132 may include a step shape, thereby forming an area thereof to be different along the formation path of the second conductive member 132.

Furthermore, the antenna module may further include the third connecting member 135 one end portion of which is connected to the second conductive member 132 and the other portion of which is connected to the first conductive member 131. A position 1317 at which the third connecting member 135 is connected to the first conductive member 131 varies a portion 1316 connected to the grounding portion 138 and a portion 1319 connected to the second connecting member 234 on the first conductive member 131, and a position at which the first connecting member 133 is connected to the second conductive member 132 varies between a portion 1323 connected to the first connecting member 133 and a portion 1324 connected to the second connecting member 134 on the second conductive member 132. However, a position 1325 at which the first connecting member 133 is connected to the first connecting member 133 may be preferably formed adjacent to the portion 1324 connected to the second connecting member 134 or the grounding portion 138.

Furthermore, the antenna module may further include the sub-arm 236 one end portion of which is connected to the first conductive member 231, and the other end portion of which is open, wherein one end portion of the sub-arm 136 is formed between a portion 1316 connected to the grounding portion 138 through the grounding line 138*a* and a portion 1317 connected to the third connecting member 135 on the first conductive member 131.

Hereinafter, a mobile terminal according to a fourth embodiment of the present disclosure will be described. A mobile terminal according to a fourth embodiment may include a terminal body and an antenna module 230 formed to operate in a first frequency band and in a second frequency band different from the first frequency band.

The antenna module 230 may include the first and the second conductive member 231, 232 fed by the first and the second feeding portion 237*a*, 237*b*, respectively, the first connecting member 233 connecting the first conductive member 231 to the second conductive member 232 at a position adjacent to the first feeding portion 237*a*, and the second connecting member 234 one end portion of which is connected to the first conductive member 231 and the other portion of which is connected to the second conductive member 232. Here, the position of the one end portion of the second connecting member 234 varies between a portion 2313 connected to the first feeding portion 237*a* and a portion 2311 at which the first connecting member 233 is connected to the first conductive member 231, and the position of the other end portion varies between a portion 2323 at which the second feeding portion 237*b* is connected to the second conductive member 232 and a portion 2321 at which the first connecting member 233 is connected to the second conductive member 232.

Here, the first conductive member 231 and second conductive member 232 are open at a position adjacent to the second feeding portion 237*b*. Furthermore, the antenna module may further include the first block member 211 formed between a portion 2322 connected to the second connecting member 234 and a portion 2323 connected to the 237*b* on the second conductive member 232 to block a current generated from the second feeding portion 237*b* from flowing to the first feeding portion 237*a*, and the second block member 212 formed on the second feeding line 2372 connected to the first feeding portion 237*a* to feed the second conductive member 232 so as to block a current generated from the first feeding portion 237*a* from flowing to the second feeding portion 237*b*.

Similarly to the foregoing third embodiment, the first conductive member 231 in the fourth embodiment may form a lateral appearance of the terminal body, and the second conductive member 232 may be disposed within the terminal body. However, it is only an example, and the first conductive member 231 may be formed within the terminal, and the second conductive member 232 may form a lateral appearance of a lateral surface of the terminal body.

Furthermore, when the first conductive member 231 or second conductive member 232 forms a lateral appearance of the terminal body, part or all of the lateral appearance of the terminal body may be formed, and separated from the remaining portion 102*b* (refer to FIG. 2) of the terminal body by a predetermined distance when forming part thereof, and preferably earthed to the ground not to allow the remaining portion 102*b* to affect on the antenna module 230. Furthermore, as illustrated in FIG. 2A, when forming all of the lateral appearance of the terminal body, one side of a lateral surface of the terminal body may be electrically separated from the inside of the terminal body by the first connecting member 233.

The first connecting member 133 and second connecting member 134 according to the first and the third embodiment of the present disclosure may be a simple fastening means such as a screw, a C-clip, a pogo pin, an EMI sheet or the like, and may not be necessarily limited in particular if it is an electrically connected means. It is similar to a case of the first connecting member 233 according to the second and the fourth embodiment. The second connecting member 234 according to the second and the fourth embodiment may be also a simple fastening means such as a screw, a C-clip, a pogo pin, an EMI sheet or the like, but preferably formed with a metal pattern due to the characteristic of connecting the first conductive member 231 to the second conductive member 232. However, the method of connecting the metal pattern to the first conductive member 231 and second conductive member 232 may be carried out using a simple fastening means such as a screw, a C-clip, a pogo pin, an EMI sheet or the like.

An antenna module 130, 230 according to the first through the fourth embodiment of the present disclosure and a mobile terminal including the same may provide an excellent performance to a narrow bezel, and it is due to an effect of the second conductive member 132, 232.

In general, antenna efficiency may be enhanced as increasing a distance between a radiator which is the conductive member 131, 132, 231, 232 and a printed circuit board 181, 281 which is the ground. Accordingly, when having a narrow bezel, a distance between the conductive member 131, 132, 231, 232 and the printed circuit board 181, 281 is decreased, thereby reducing antenna efficiency.

In other words, as illustrated in FIG. 5, when a current (I1) flowing through the first conductive member 131 flows in the same direction (I2) through the second conductive member 132, a current flows through the circuit board 181, which is the ground, in a direction (I3) opposite to the direction of the current (I1) flowing through the first conductive member 231. In this case, the current (I1) flowing through the first conductive member 131 and the current (I3)

flowing through the ground generate interference (out of phase) cancelled out each other, and the current (I2) flowing through the second conductive member 132 and the current (I3) flowing through the ground generate interference (in phase) overlapped and reinforced each other since the current flowing directions are the same. In other words, a current intensity that has been weaken by the current (I1) flowing through the first conductive member 131 and the current (I3) flowing through the circuit board 181 is reinforced by an overlapping effect of the current (I2) flowing through the second conductive member 232 and the current (I3) flowing through the circuit board 181, and as a result, even in case of a mobile terminal having a narrow bezel, it may be possible to implement an antenna efficiency similar to that having a wide bezel.

The foregoing present invention may be implemented as codes readable by a computer on a medium written by the program. The computer-readable media may include all kinds of recording devices in which data readable by a computer system is stored. Examples of the computer-readable media may include a hard disk drive (HDD), a solid state disk (SSD), a silicon disk drive (SDD), a ROM, a RAM, a CD-ROM, a magnetic tape, a floppy disk, and an optical data storage device, and the like, and also include a device implemented in the form of a carrier wave (for example, transmission via the Internet). In addition, the computer may include the controller 180 of the mobile terminal. Accordingly, the detailed description thereof should not be construed as restrictive in all aspects but considered as illustrative. The scope of the invention should be determined by reasonable interpretation of the appended claims and all changes that come within the equivalent scope of the invention are included in the scope of the invention.

What is claimed is:

1. An antenna module, comprising:

a first conductive member connected to a feeding portion and a grounding portion, wherein the first conductive member is shaped to define a slit between the feeding portion and the grounding portion;

a second conductive member positioned relative to the first conductive member to define a region therebetween member;

a first connecting member connecting the first conductive member to the second conductive member; and a second connecting member connecting the first conductive member to the second conductive member, and wherein the first conductive member comprises a first portion connected to the grounding portion and a second portion connected to the feeding portion to form the slit separated from the first portion by a distance, and wherein a first matching module for impedance matching is disposed on a feeding line connected to the feeding portion to feed the first conductive member.

2. The antenna module of claim 1, wherein the first connecting member connects the first conductive member to the second conductive member at a location between a portion connected to the feeding portion an end of the first conductive member.

3. The antenna module of claim 2, wherein the second connecting member connects the first conductive member to the second conductive member at a location between a portion connected to the grounding portion an end of the first conductive member.

4. The antenna module of claim 3, further comprising:

a third connecting member comprising first and second end portions, wherein the first end portion is connected to the first conductive member, and the second end portion is connected to the second conductive member, wherein the first end portion is connected to the first conductive member at a location between the portion connected to the grounding portion and a portion connected to the second connecting member, and wherein the second end portion is connected to the second conductive member at a location between the portion connected to the first connecting member and the portion connected to the second connecting member.

5. The antenna module of claim 4, further comprising:

a sub-arm comprising first and second end portions, wherein the first end portion of the sub-arm is connected to the first conductive member, the second conductive member, or grounded to the ground, and the second end portion of the sub-arm is open, wherein the first end portion of the sub-arm is formed between a portion connected to the grounding portion and a portion connected to the third connecting member when the first end portion of the sub-arm is connected to the first conductive member, and wherein the first end portion of the sub-arm is formed between a portion connected to the first connecting member and a portion connected to the third connecting member when the first end portion of the sub-arm is connected to the second conductive member, and at least part of the second end portion of the sub-arm is formed adjacent to the second conductive member to be separated therefrom when the first end portion of the sub-arm is connected to the ground.

6. The antenna module of claim 1, wherein a first variable switch for controlling a current flowing through the second portion is connected to the first matching module.

7. The antenna module of claim 1, wherein a second matching module for impedance matching is disposed on a grounding line connected to the grounding portion to ground the first conductive member.

8. The antenna module of claim 7, wherein a second variable switch for controlling a current flowing through the first portion is connected to the second matching module.

9. The antenna module of claim 8, wherein a third variable switch for controlling a current flowing through the sub-arm is formed on the sub-arm.

10. An antenna module, comprising:

a first conductive member fed by a first feeding portion;

a second conductive member disposed to be separated from the first conductive member and fed by a second feeding portion;

a first connecting member connecting the first conductive member to the second conductive member at a position adjacent to the first feeding portion; and a second connecting member comprising a first end portion and a second end portion, wherein the first end portion is connected to the first conductive member and the second end portion is connected to the second conductive member, wherein a position of the first end portion is between a portion connected to the first feeding portion and an end of the first conductive member, and a position of the second end portion is between a portion connected to the second feeding portion and an end of the second conductive member, wherein the first conductive member and second conductive member are open at a position adjacent to the second feeding portion.

11. The antenna module of claim 10, further comprising:

a sub-arm comprising first and second end portions formed on the second conductive member, wherein the first end portion of the sub-arm is formed between a portion connected to the second feeding portion and an open end of the second conductive member, and the second end portion of the sub-arm is open.

12. The antenna module of claim 11, further comprising:

a first block member formed between a portion connected to the second connecting member and a portion connected to the second feeding portion on the second conductive member to block a current generated from the second feeding portion from flowing to a first feeding portion.

13. The antenna module of claim 12, further comprising:

a second block member formed on a second feeding line connected to the second feeding portion to feed the second conductive member to block a current generated from the first feeding portion from flowing to a second feeding portion.

14. The antenna module of claim 13, wherein the first block member and the second block member are configured to include a lumped element.

15. The antenna module of claim 11, wherein at least part of the sub-arm is formed adjacent to the first conductive member to be separated therefrom to generate an electric coupling to the first conductive member.

16. The antenna module of claim 10, wherein the first conductive member is grounded to the ground by a grounding line, and a second variable switch is formed on the grounding line.

17. The antenna module of claim 10, wherein a first matching module is formed on a first feeding line for feeding the first conductive member.

18. The antenna module of claim 17, wherein a first variable switch for controlling a current flowing through the first conductive member is connected to the first matching module.

19. A mobile terminal, comprising:

a terminal body; and an antenna module formed on the terminal body, wherein the antenna module comprises:

a first conductive member;

a second conductive member positioned relative to the first conductive member to define a region therebetween;

a first connecting member connecting an end of the first conductive member to an end of the second conductive member; and a second connecting member configured to connect an end of the first conductive member to an end of the second conductive member, wherein the first conductive member is connected to a feeding portion and a grounding portion, wherein either the first conductive member or the second conductive member is shaped to define a slit that is formed between the feeding portion and grounding portion, and wherein the first conductive member comprises a first portion connected to the grounding portion and a second portion connected to the feeding portion to form the slit separated from the first portion by a distance, and wherein a first matching module for impedance matching is disposed on a feeding line connected to the feeding portion to feed the first conductive member.

20. The mobile terminal of claim 19, wherein one of the first conductive member or the second conductive member forms part or all of a lateral appearance of the terminal body, and other one of the first conductive member or the second conductive member is formed within the terminal body.

21. The mobile terminal of claim 19, wherein the first conductive member and the second conductive member are formed on respective planes, and the planes are formed to be perpendicular to each other.

22. The mobile terminal of claim 19, wherein the second conductive member is formed in a non-uniform pattern.

23. The mobile terminal of claim 19, wherein a position at which the first connecting member is connected to the first conductive member is between a portion connected to the feeding portion and an end of the first conductive member.

24. The mobile terminal of claim 19, wherein a position at which the second connecting member is connected to the first conductive member is between a portion connected to the grounding portion and an end of the first conductive member.

25. A mobile terminal, comprising:

a terminal body; and an antenna module formed on the terminal body, wherein the antenna module comprises:

a first conductive member fed by a first feeding portion;

a second conductive member positioned relative to the first conductive member to define a region therebetween, wherein the second conductive member is fed by second feeding portion;

a first connecting member configured to connect the first conductive member to the second conductive member at a position adjacent to the first feeding portion; and a second connecting member comprising first and second end portions, wherein the first end portion is connected to the first conductive member, and the second end portion is connected to the second conductive member, wherein a position of the first end portion is between a portion connected to the first feeding portion and an end of the first conductive member, and a position of the second end portion is between the second feeding portion and an end of the second conductive member, wherein the first conductive member and the second conductive member are open at a position adjacent to the second feeding portion.

26. The mobile terminal of claim 25, wherein one of the first conductive member or the second conductive member forms part or all of a lateral appearance of the terminal body, and the other one of the first conductive member or the second conductive member is disposed within the terminal body.

27. The mobile terminal of claim 25, further comprising:

a first block member formed between a portion connected to the second connecting member and a portion connected to the second feeding portion on the second conductive member to block a current generated from the second feeding portion from flowing to a first feeding portion.

28. The mobile terminal of claim 25, further comprising:

a second block member formed on a second feeding line connected to the first feeding portion to feed the second conductive member to block a current generated from the first feeding portion from flowing to a second feeding portion.

29. The mobile terminal of claim 25, further comprising:

a sub-arm comprising first and second end portions and being formed on the second conductive member, where the first end portion of the sub-arm is formed between a portion connected to the second feeding portion and an open end of the second conductive member, and the second portion is open.

* * * * *